US005967815A

United States Patent [19]

Schlessinger et al.

[11] Patent Number: 5,967,815

[45] Date of Patent: Oct. 19, 1999

[54] VARIABLE ORIENTATION SWITCHING TYPE ELECTRICAL RECEPTACLE

[75] Inventors: Marc A. Schlessinger, 25035 Margot Ct., Beachwood, Ohio 44122; Myron E. Ullman, Jr., Canfield, Ohio

[73] Assignee: Marc A. Schlessinger, Beachwood, Ohio

[21] Appl. No.: 09/039,519

[22] Filed: Mar. 19, 1998

[51] Int. Cl.[6] ..... H01R 29/00

[52] U.S. Cl. ..... 439/188; 200/51.09; 439/954

[58] Field of Search ..... 439/188, 954; 77/650, 51.09; 200/51.1

[56] References Cited

U.S. PATENT DOCUMENTS

| | | | |
|---|---|---|---|
| 866,105 | 9/1907 | Whittlesey | 439/139 |
| 1,174,379 | 3/1916 | Bacon | 439/17 |
| 1,176,554 | 3/1916 | Herzig | 439/17 |
| 1,247,660 | 11/1917 | Garrison | 439/21 |
| 1,591,773 | 7/1926 | Nero | 439/539 |
| 1,641,265 | 9/1927 | Gaynor | 439/650 |
| 1,669,666 | 5/1928 | Laub | 200/51 R |
| 1,700,437 | 1/1929 | Hubbell | 200/51 R |
| 1,712,301 | 5/1929 | Glidden | 439/17 |
| 1,720,619 | 7/1929 | Baldwin | 439/27 |
| 1,733,222 | 10/1929 | Gehring | 439/539 |
| 1,768,260 | 6/1930 | Larkey | 439/17 |
| 1,774,230 | 8/1930 | Fagerlund | 200/51 R |
| 1,830,466 | 11/1931 | Hines | 439/539 |
| 1,915,070 | 6/1933 | Muldoon | 439/538 |
| 1,927,245 | 9/1933 | Russell | 173/330 |
| 1,989,693 | 2/1935 | Hubbell, Jr. | 173/330 |
| 2,012,036 | 8/1935 | Cook | 173/330 |
| 2,040,113 | 5/1936 | Von Holtz | 173/330 |
| 2,055,991 | 9/1936 | Caldwell | 173/324 |
| 2,119,428 | 5/1938 | Englar | 247/23 |
| 2,154,159 | 4/1939 | Hamilton | 173/330 |
| 2,154,160 | 4/1939 | Hamilton | 173/330 |
| 2,155,925 | 4/1939 | Blinn | 173/328 |
| 2,175,472 | 10/1939 | Kuhlman | 173/330 |
| 2,184,359 | 12/1939 | Mueller | 200/51 |
| 2,201,875 | 5/1940 | Zelt | 200/51 |
| 2,215,316 | 9/1940 | Benander | 173/330 |
| 2,224,366 | 12/1940 | Johnston | 200/51 |
| 2,248,759 | 7/1941 | Hollander | 173/324 |
| 2,262,712 | 11/1941 | Shenton | 173/330 |
| 2,315,523 | 4/1943 | Hubbell | 173/330 |
| 2,336,218 | 12/1943 | Blinn | 173/328 |

(List continued on next page.)

*Primary Examiner*—Neil Abrams
*Assistant Examiner*—Michael C. Zarroli
*Attorney, Agent, or Firm*—David A. Burge

[57] ABSTRACT

An electrical receptacle includes a housing that is defined by identical nonconductive housing halves which are held in side-by-side assembled relationship by a metal mounting bracket. The mounting bracket carries a ground wire connection screw that extends through a rear wall of the housing and threads into a threaded rear end region of a metal post which extends centrally through the housing to provide a threaded front end region configured to receive a cover plate mounting screw. Two nonconductive rotors are journaled by the housing for independent rotation between "off" positions and various "on" orientations for selectively supplying electrical energy to sets of female contacts that are carried by the rotors. A leaf spring is carried within the hollow interior of the housing for engaging detent formations of the rotors for releasably retaining the rotors in "off" and "on" orientations. The rotor carried contacts have front end regions that are configured to receive and conductively engage the metal prongs of conventional male plugs, and rear end regions that are configured to selectively engage forwardly facing conductive surfaces provided on at least one circuit board which is carried within the hollow interior of the housing near the rear wall of the housing. Wire connection terminals carried on opposite sides of the housing deliver electrical energy to the electrically conductive surfaces of the circuit board. Crimpable formations provided on the metal mounting bracket and/or the metal post may be utilized to maintain the assembled relationships of components of the receptacle.

54 Claims, 6 Drawing Sheets

U.S. PATENT DOCUMENTS

| | | | |
|---|---|---|---|
| 2,414,957 | 1/1947 | Larrabure | 173/324 |
| 2,419,585 | 4/1947 | O'Brien et al. | 200/51.09 |
| 2,455,582 | 12/1948 | Hoessel | 173/330 |
| 2,459,032 | 1/1949 | Korth | 173/324 |
| 2,477,803 | 8/1949 | Huber | 173/330 |
| 2,498,643 | 2/1950 | Bellek | 173/330 |
| 2,500,474 | 3/1950 | Sperrazza | 200/51.09 |
| 2,507,654 | 5/1950 | Stubbs | 173/330 |
| 2,515,003 | 7/1950 | Hamilton | 173/330 |
| 2,515,870 | 7/1950 | Hamilton | 173/330 |
| 2,524,250 | 10/1950 | Bierce | 173/330 |
| 2,531,625 | 11/1950 | Hubbell | 200/51.09 |
| 2,532,219 | 11/1950 | Bierce | 173/330 |
| 2,540,496 | 2/1951 | Sperrazza | 200/51.09 |
| 2,545,536 | 3/1951 | Von Holtz | 173/330 |
| 2,570,784 | 10/1951 | Ferguson | 173/324 |
| 2,579,538 | 12/1951 | Bierce | 173/330 |
| 2,611,068 | 9/1952 | Wellens | 219/19 |
| 2,618,677 | 11/1952 | Parish et al. | 173/330 |
| 2,641,627 | 6/1953 | Lewis | 174/67 |
| 2,672,593 | 3/1954 | Shenton | 339/14 |
| 2,686,297 | 8/1954 | Hutt | 339/14 |
| 2,704,831 | 3/1955 | Smith | 339/91 |
| 2,735,906 | 2/1956 | Avrunin | 200/51.09 |
| 2,744,243 | 5/1956 | Menendez | 339/36 |
| 2,752,581 | 6/1956 | Benander | 339/41 |
| 2,770,786 | 11/1956 | Czyzewski | 339/40 |
| 2,787,676 | 4/1957 | Kellogg et al. | 200/51.09 |
| 2,826,652 | 3/1958 | Piplack | 200/51.09 |
| 2,872,654 | 2/1959 | Smith | 339/14 |
| 2,974,301 | 3/1961 | Slater | 339/14 |
| 2,986,612 | 5/1961 | Healy | 200/51 |
| 3,029,405 | 4/1962 | Buchanan | 339/14 |
| 3,032,736 | 5/1962 | Howells | 339/14 |
| 3,066,276 | 11/1962 | Hubbell et al. | 339/189 |
| 3,096,132 | 7/1963 | Hubbell | 339/36 |
| 3,120,414 | 2/1964 | Farish, Jr. | 339/14 |
| 3,126,239 | 3/1964 | Winter et al. | 339/14 |
| 3,148,926 | 9/1964 | Winter | 339/14 |
| 3,173,731 | 3/1965 | Anderson | 339/14 |
| 3,178,666 | 4/1965 | Smith | 339/14 |
| 3,206,705 | 9/1965 | Smith | 339/14 |
| 3,222,631 | 12/1965 | Cohen | 339/40 |
| 3,233,204 | 2/1966 | DeVore, Jr. | 339/45 |
| 3,238,492 | 3/1966 | Houston | 339/40 |
| 3,343,117 | 9/1967 | Carlson | 339/14 |
| 3,363,215 | 1/1968 | Smith | 339/14 |
| 3,369,211 | 2/1968 | Sundquist | 339/14 |
| 3,426,216 | 2/1969 | Smith et al. | 307/112 |
| 3,441,896 | 4/1969 | Hawkins | 339/14 |
| 3,524,072 | 8/1970 | Tsergas | 307/112 |
| 3,596,019 | 7/1971 | Koester | 200/51.09 |
| 3,601,758 | 8/1971 | Davidsson | 339/40 |
| 3,617,662 | 11/1971 | Miller | 200/51.09 |
| 3,636,494 | 1/1972 | Smith | 339/14 R |
| 3,668,607 | 6/1972 | Farnworth | 339/41 |
| 3,688,239 | 8/1972 | Jaconette | 339/14 R |
| 3,699,285 | 10/1972 | Leatherman | 200/51.09 |
| 3,701,074 | 10/1972 | Oster | 339/14 R |
| 3,723,948 | 3/1973 | Wyatt et al. | 339/99 R |
| 3,755,635 | 8/1973 | McGill | 200/51.09 |
| 3,775,726 | 11/1973 | Gress | 339/14 R |
| 3,846,598 | 11/1974 | Mucsi | 200/51.09 |
| 3,963,292 | 6/1976 | Smith | 339/14 R |
| 3,980,372 | 9/1976 | Ranzanigo | 339/41 |
| 3,982,084 | 9/1976 | Cooperstein | 200/51.09 |
| 3,986,763 | 10/1976 | Sparrow | 339/40 |
| 3,990,758 | 11/1976 | Petterson | 339/43 |
| 4,019,797 | 4/1977 | Praiml | 339/14 P |
| 4,037,901 | 7/1977 | Kaszuba | 339/41 |
| 4,072,382 | 2/1978 | Reschke | 339/40 |
| 4,148,536 | 4/1979 | Petropoulsos et al. | 339/42 |
| 4,168,104 | 9/1979 | Buschow | 339/40 |
| 4,172,628 | 10/1979 | Lingaraju | 339/95 |
| 4,179,175 | 12/1979 | Farnworth et al. | 339/42 |
| 4,195,290 | 3/1980 | Magil et al. | 340/568 |
| 4,203,638 | 5/1980 | Tansi | 339/14 R |
| 4,240,686 | 12/1980 | Kurbikoff | 339/14 R |
| 4,271,337 | 6/1981 | Barkas | 200/51.09 |
| 4,375,307 | 3/1983 | Rock | 339/14 R |
| 4,379,605 | 4/1983 | Hoffman | 339/14 R |
| 4,379,607 | 4/1983 | Bowden, Jr. | 339/40 |
| 4,544,219 | 10/1985 | Barkas | 339/40 |
| 4,545,631 | 10/1985 | Zampini | 339/14 R |
| 4,584,430 | 4/1986 | Belknap | 174/67 |
| 4,722,693 | 2/1988 | Rose . | |
| 4,822,290 | 4/1989 | Cauley et al. | 439/137 |
| 4,854,885 | 8/1989 | Bowden, Jr. et al. | 139/107 |
| 4,867,694 | 9/1989 | Short | 439/137 |
| 4,909,749 | 3/1990 | Long | 439/263 |
| 4,927,373 | 5/1990 | Dickie | 439/188 |
| 4,932,886 | 6/1990 | Glaser | 439/137 |
| 4,995,017 | 2/1991 | Sellati et al. | 307/86 |
| 5,006,075 | 4/1991 | Bowden, Jr. | 439/137 |
| 5,020,997 | 6/1991 | Calderara et al. | 439/137 |
| 5,026,299 | 6/1991 | Foulk | 439/137 |
| 5,035,635 | 7/1991 | Tsai et al. | 139/188 |
| 5,066,238 | 11/1991 | Shieh | 439/139 |
| 5,095,182 | 3/1992 | Thompson | 200/51.09 |
| 5,098,307 | 3/1992 | Francisco | 439/189 |
| 5,113,045 | 5/1992 | Crofton | 200/51.09 |
| 5,186,639 | 2/1993 | Comerci et al. | 439/188 |
| 5,266,039 | 11/1993 | Boyer et al. | 439/107 |
| 5,267,870 | 12/1993 | Maresh | 439/139 |
| 5,281,154 | 1/1994 | Comerci et al. | 439/107 |
| 5,281,155 | 1/1994 | Comerci et al. | 439/107 |
| 5,286,213 | 2/1994 | Altergott et al. | 439/107 |
| 5,320,545 | 6/1994 | Brothers | 439/188 |
| 5,350,310 | 9/1994 | Chen | 439/188 |
| 5,378,165 | 1/1995 | Comerci et al. | 439/188 |
| 5,429,518 | 7/1995 | Chen | 439/188 |
| 5,472,350 | 12/1995 | Mehta | 439/107 |
| 5,484,299 | 1/1996 | Schlessinger | 439/188 |

VARIABLE ORIENTATION SWITCHING TYPE ELECTRICAL RECEPTACLE

BACKGROUND OF THE INVENTION

1. Field of the Invention

The present invention relates to improvements in a switching type electrical receptacle having a housing that journals a pair of contact carriers or "rotors" that are rotatable between "off" positions and various "on" orientations—improvements that permit a switching receptacle of the basic type disclosed in U.S. Pat. No. 5,484,299 issued Jan. 16, 1996 to Marc A. Schlessinger to be assembled with ease from a minimal number of relatively inexpensively formed components including at least one circuit board that is carried within the hollow interior of the housing, and including two identically configured, nonconductive housing halves that are connected to and held in assembled relationship by an elongate metal mounting bracket for journaling two identically configured nonconductive rotors that carry contacts which extend rearwardly to engage conductive surfaces of the circuit board, with a housing carried leaf spring interacting with detent formations of the rotors to releasably detain the rotors in "off" and selected "on" orientations, and with other features being provided by utilizing components of novel configuration and arrangement to provide a variable orientation switching receptacle that is well suited for use as a replacement for conventional electrical receptacles.

2. Prior Art

The vast majority of electrical receptacles that are installed in the walls of homes, apartments, offices and the like are of the type that include one or more sets of fixed-position female electrical contacts that are configured to receive prongs (male electrical contacts) of appropriately oriented cord-connected plugs. To utilize such receptacles, the power cord of an electrical appliance is extended from the location of the appliance to the location of a wall-mounted receptacle; the cord-connected plug of the appliance is properly oriented such that its prongs are suitably aligned with a set of female contacts of the receptacle; and the properly aligned prongs of the plug are inserted into the receptacle to permit the female contacts to engage, grip and establish electrical contact with the inserted prongs.

A drawback of receptacles of the type just described is that, due to the fixed-orientation character of their female contacts, it often is found that plugs (and electrical cords connected thereto) that are connected to such receptacles interfere with proper placement of furniture and the like. To resolve such conflicts, it is not unknown for plugs to be bent or otherwise detrimentally deformed (and/or for cords connected thereto to be bent sharply or otherwise detrimentally deformed—which can lead to cords becoming frayed, shorted or broken) to conform to limited available space, with the result that fire and electrical hazards may be created.

Another drawback of receptacles having fixed-position contacts is that, if a non-standard plug (e.g., a plug of oversize or cumbersome design, or a right-angle plug or the like) is "plugged into" one of the stations of a two-station receptacle, the configuration of the nonstandard plug (and/or the orientation of an electrical cord connected to the non-standard plug) may block the other station of the receptacle, thereby preventing use of the second station. Stated in another way, while it may normally be possible to connect two "standard" plugs to a two-station receptacle, the connection of a "non-standard" plug to one of the receptacle's stations may prevent the other station of the receptacle from concurrently receiving and serving a second plug.

Still another drawback of receptacles having fixed-position contacts is that no provision is made for "deactivating" individual sets of female contacts as a safeguard to ensure that toddlers (who have been known to stick metal objects into the slots of such receptacles) will not be painfully shocked or electrocuted. While it is known to deactivate a receptacle by operating a circuit breaker or an electrical switch, this approach often proves to be inconvenient and/or unacceptable. For example, it often is desired to make use of one set of contacts of a receptacle to operate a lamp or other form of appliance while a remaining set of contacts of the receptacle remains idle. "Idle" contacts that are not deactivated are "alive" (i.e., are connected to a source of electrical energy) and therefore present a hazard to a toddler who decides to probe the "idle" contacts by inserting metal objects into receptacle openings.

The switching type electrical receptacle disclosed in U.S. Pat. No. 5,484,299 issued Jan. 16, 1996 to Marc A. Schlessinger (referred to hereinafter as the "Basic Patent," the disclosure of which is incorporated herein by reference) addresses the foregoing and other needs and drawbacks of the prior art by providing a novel and improved electrical receptacle that utilizes at least one generally cylindrical, nonconductive contact carrier or "rotor" that is rotatably mounted by a surrounding nonconductive housing for selectively connecting rotor carried contacts with housing-carried contacts (and thence to a source of electrical energy) when the rotor is rotated to an "on" orientation that resides within a predetermined angular range of "on" orientations, and that interrupts such connection when the rotor is rotated relative to the housing to an "off" orientation.

A feature of the invention of the Basic resides in its providing a very simple, easy-to-use method for "deactivating" a set of female contacts of a receptacle. A particular set of female contacts can be deactivated simply by rotating its carrier relative to the housing to an "off" orientation. In preferred practice, this "deactivating" movement of a rotatable contact carrier can be effected either by grasping and rotating a plug that is "plugged into" the carrier that is to be rotated, or by rotating the carrier itself (if no plug currently is "plugged into" the carrier).

Another feature of the invention of the Basic Patent is the easy-to-use method it provides for selectively orienting electrical plugs (and their attached electrical cords) that are "plugged into" sets of female contacts of electrical receptacles. Because receptacles that embody the preferred practice of the invention utilize sets of female electrical contacts that are housed within individually rotatable carriers, and because these carriers are rotatable within relatively wide angular ranges of "on" orientations, electrical plugs (and their attached electrical cords) can be individually oriented as is needed to minimize interference in properly positioning furniture and the like at locations adjacent installed receptacles.

In preferred practice, an electrical receptacle that embodies the invention of the Basic Patent includes a nonconductive housing, a nonconductive carrier or "rotor" that is connected to the housing for relative rotation thereto, a set of housing-carried electrical contacts, and a set of carrier-carried electrical contacts, with these components being arranged and configured in a manner that will permit the housing-carried and carrier-carried contacts to remain electrically connected while the orientations of the contact carriers are suitably adjusted to accommodate special needs of particular receptacle installations.

In accordance with the preferred practice of the invention of the Basic Patent, a mechanical "detent" also is incorporated in receptacles of the above-described type for "detenting" each rotatable carrier at its "off" orientation— so that, once the carrier has been rotated to its "off" orientation, slightly more than "normal" force (i.e., more force than normally is required to effect carrier rotation) must be applied to rotate the carrier out of its "off" orientation. By this arrangement, if a toddler has come to comprehend that the carrier of a receptacle is "rotatable," the requirement that "slightly more force than normal" be used to effect carrier rotation out of an "off" orientation will assist in providing a safeguard.

SUMMARY OF THE INVENTION

The present invention relates to improvements in receptacle of the general type that are described in the Basic Patent—improvements that permit a selective orientation switching type electrical receptacle to be easily assembled from a minimal number of relatively inexpensively formed components.

A significant feature of the present invention resides in its novel use of a very limited number of specially configured nonconductive components together with a relatively small number of inexpensive-to-form metal components and a relatively simple circuit board to provide a variable orientation duplex receptacle that incorporates a pair of switches—and yet is of sufficiently compact configuration to permit its use as a replacement for conventional fixed-orientation non-switching receptacles of the type commonly found in homes and offices.

Features of the invention reside in the use that is made of identical left and right housing halves positioned side-by-side to define a nonconductive housing having a hollow interior wherein first and second passages are cooperatively defined that open through a front wall of the housing—and wherein interior formations preferably are provided that perform a plurality of specialized functions such as 1) supporting a circuit board at the rear of the hollow interior for providing electrically conductive surfaces at the rear of the first and second passages, 2) supporting a metal center-post that extends centrally through the housing and provides a ground connection to the circuit board, 3) supporting portions of left and right wire connection terminals that extend into the hollow interior for connecting the circuit board to a source of electrical energy, 4) journaling first and second rotors within the first and second passages for rotation relative to the housing among "off" and "on" orientations, 5) defining first and second chambers that receive flange-like projections formed on the first and second rotors for preventing axial movement of the rotors relative to the housing, and 6) providing support for a leaf spring that interacts with the flange-like projections to "detent" the rotors in selected "off" and "on" orientations.

In preferred practice the objectives mentioned just above are achieved utilizing left and right housing halves that not only are identically configured but also are designed to permit their being molded relatively inexpensively from plastics material—typically through the use of injection molds that do not require relatively movable mold components such as "side core pulls" which add significantly to the cost of molds themselves, and to costs associated with operating and maintaining the molds.

In preferred practice, identical first and second rotors are employed that also are configured to permit their being formed utilizing relatively inexpensive techniques of injection molding. The rotors preferably are of generally cylindrical outer shape and have front walls through which contact-receiving passages open that are arranged in arrays that will permit the metal prongs of conventional electrical plugs to be received therein. The rotors preferably also have hollow interiors that open rearwardly to receive generally cylindrical inserts that preferably are formed by injection molding. The rotors and their cylindrical inserts cooperate to mount metal contacts that extend forwardly into the contact-receiving passages, and that extend rearwardly in the first and second housing passages to selectively engage the electrically conductive surfaces of the circuit board.

A further feature of the preferred practice of the present invention resides in the provision of connecting formations that are cooperatively defined by the left and right housing halves at opposite ends of the housing, and in the use of a metal mounting bracket that has formations for receiving and gripping the connecting formations to retain the left and right housing halves in side-by-side assembly. The connecting formations preferably are wedge-shaped or dovetail-shaped in cross-section, with each having left and right halves that are defined by the left and right housing halves, respectively. The mounting bracket formations preferably grip the connecting formations at locations of minimal cross-sectional width so that the wedge-shaped or dovetail-shaped cross-sections of the connecting formations aid in maintaining the grip of the mounting bracket formations on the connecting formations. In preferred practice, the mounting bracket formations take the form of elongate slots that slidingly engage the connecting formations as the mounting bracket is slided forwardly onto the housing to an assembled position wherein a central part of the mounting bracket closely overlies the rear wall of the housing.

In preferred practice, the circuit board which is carried toward the rear of the hollow interior of the housing defines first and second forwardly-facing recesses that open into the first and second passages. Annular electrically conductive surfaces preferably are defined by the circuit board that perimetrically ring the recesses, and the rotor-carried contacts include contacts that engage these annular surfaces to provide ground connections to the rotors regardless of their orientations. Round electrically conductive surfaces preferably are defined by the circuit board that are located centrally within the recesses, and the rotor-carried contacts include contacts that engage these round surfaces. C-shaped electrically conductive surfaces preferably are defined by the circuit board that extend about the round surfaces at locations within the recesses spaced from the round surfaces, and the rotor-carried contacts include contacts that engage the C-shaped surfaces when the rotors are in their "on" orientations, and disengage the C-shaped surfaces when the rotors are in their "off" orientations—whereby switching functions are incorporated into the receptacle in quite a simple manner.

By utilizing components of the type described that are arranged in the manner described, a full-featured receptacle of compact size but of complex character is provided having a pair of rotors that can be independently positioned in a variety of "on" orientations for supplying electrical energy to electrical plugs connected thereto, and that can be rotated to "off" orientations to de-energize their contacts for purposes of safety—a receptacle formed from a relatively small number of inexpensively formed components that are easy to assemble—a receptacle that is well suited to replace the limited-feature receptacles that are found in present-day homes and offices.

BRIEF DESCRIPTION OF THE DRAWINGS

The foregoing and other features of the invention will be better understood by referring to the description and claims which follow, taken together with the accompanying drawings, wherein:

DESCRIPTION OF THE PREFERRED EMBODIMENT

Figure 1:
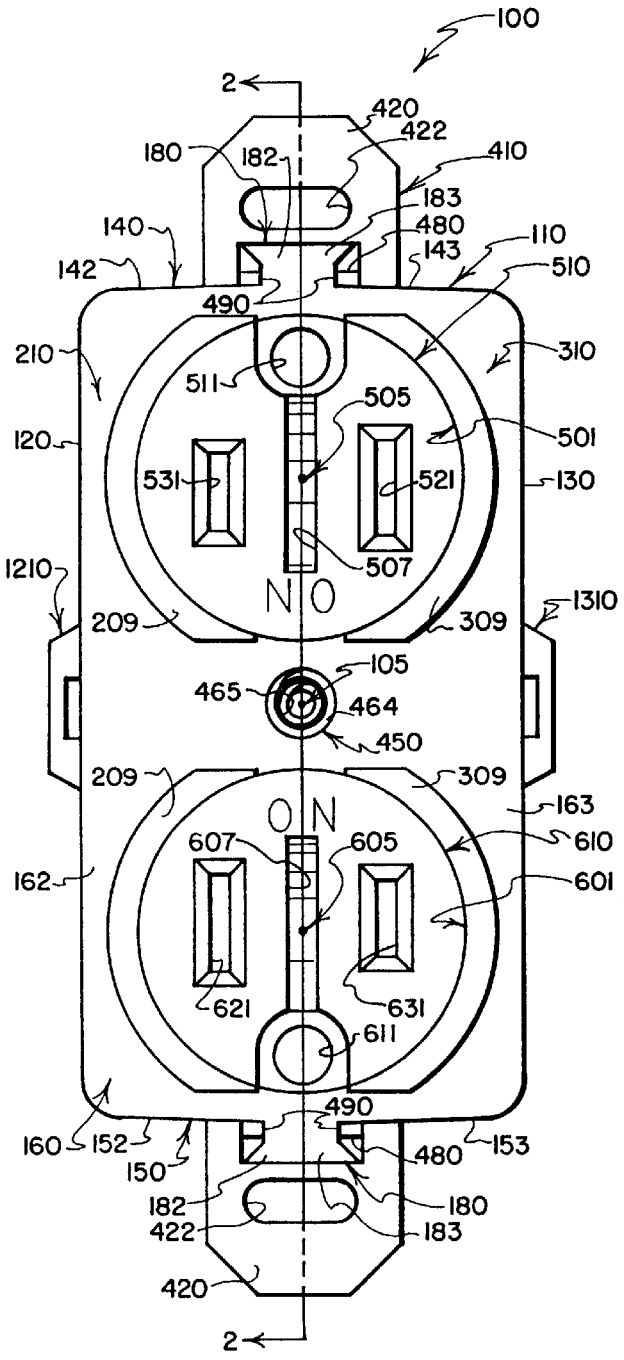
FIG. 1 is a front elevational view of a preferred form of switching type electrical receptacle having two rotatable contact carriers or "rotors" that each carry a separate set of electrical contacts, with the upper of the receptacle's two rotors being angularly oriented relative to a housing of the receptacle in what will be referred to as the "off" orientation, and with the lower of the rotors being angularly oriented relative to the housing in a typical "on" orientation.
Figure 2:
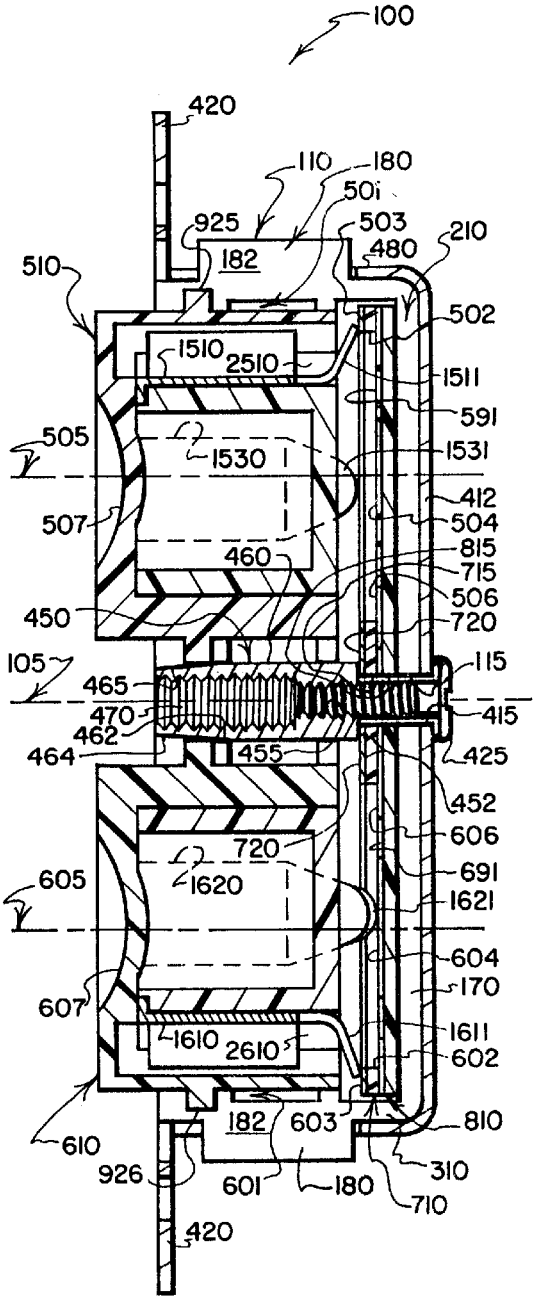
FIG. 2 is a sectional view, as seen from a plane indicated by a line 2—2 in FIG. 1.
Figure 3:
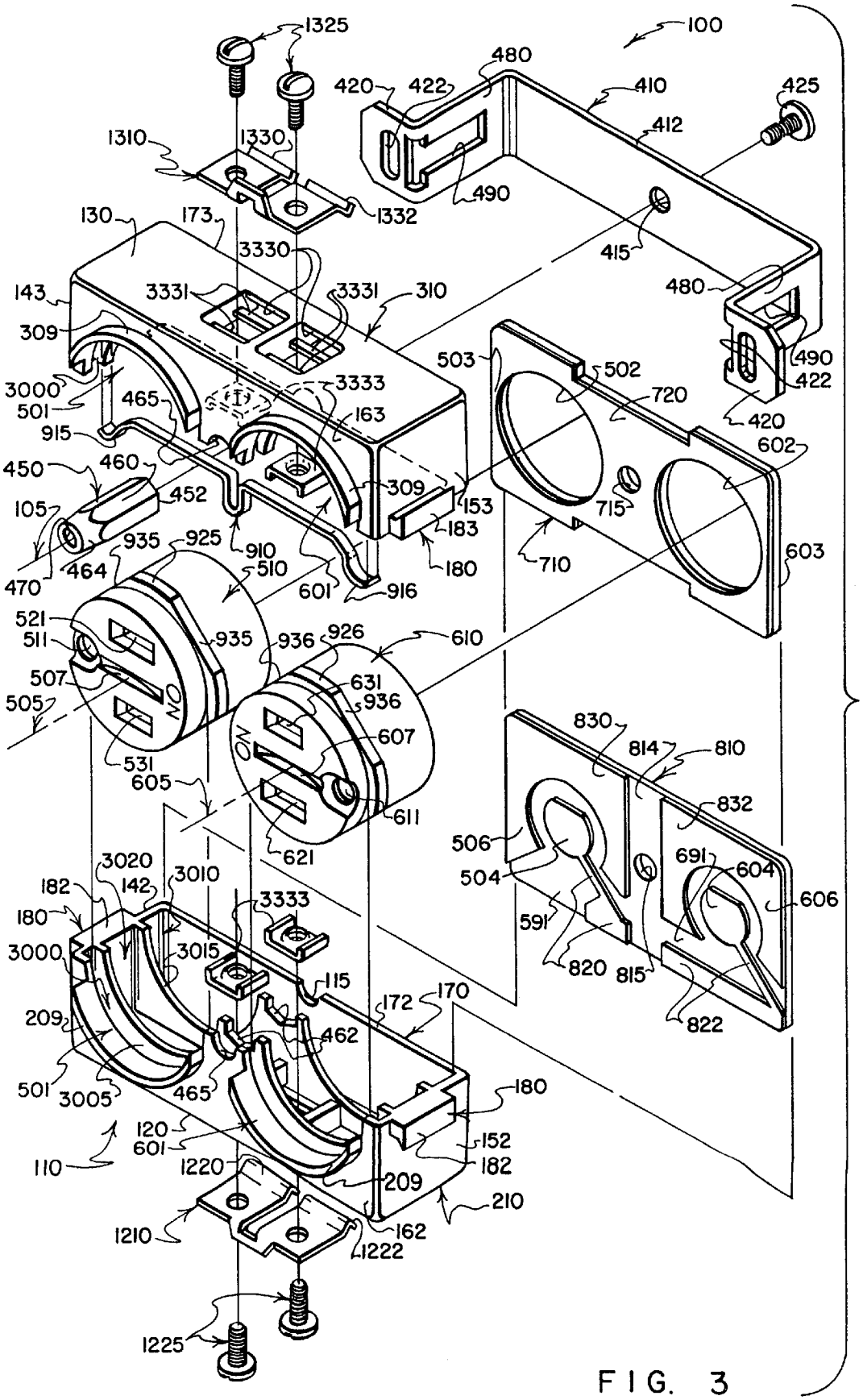
FIG. 3 is an exploded perspective view of selected components and subassemblies of the receptacle of FIGS. 1 and 2, with a left one of the receptacle's two rotors in the "off" orientation, and with the right one of the rotors in the "on" orientation that is depicted in FIG. 1.

Referring to FIGS. 1–3, a switching type electrical receptacle that embodies the best mode presently known to the inventors for carrying out the preferred practice of the present invention is indicated generally by the numeral 100. A brief overview of the receptacle 100 will be provided before turning to a more detailed description of its features.

Major components of the receptacle 100 include an electrically nonconductive housing 110 formed from identical left and right housing halves 210, 310 that are connected to a mounting bracket 410. The mounting bracket 410 has end regions 420 that are provided with slots 422 for receiving conventional flat-head screws (not shown) for mounting the receptacle 100 in a conventional manner in a variety of commercially available electrical connection boxes (not shown), as will be readily understood by those who are skilled in the art.

Major components of the receptacle 100 also include identical first and second electrically nonconductive rotors 510, 610 which are journaled by the housing 110 for rotation about first and second axes 505, 605 (see FIG. 2) that extend parallel to a central axis 105 of the housing 110. The first and second rotors 510, 610 are housed within first and second generally cylindrical, forwardly opening passages 501, 601 that are cooperatively defined by the left and right housing halves 210, 310. The first and second rotor axes 505, 605 are located on opposite sides of the center axis 105, and are spaced equidistantly therefrom. Referring still to FIG. 2, the mounting bracket 410 has an elongate central portion 412 which extends along the exterior of a back wall 170 of the housing 110. Holes 115, 415 that align with the center axis 105 are formed through the back wall 170 and through the central portion 412. A ground wire connection screw 425 extends through the holes 115, 415 and threads into a threaded rear end region 455 of a metal mounting post 450 that extends along the center axis 105 at a central location within the hollow interior of the housing 110.

Figure 7:
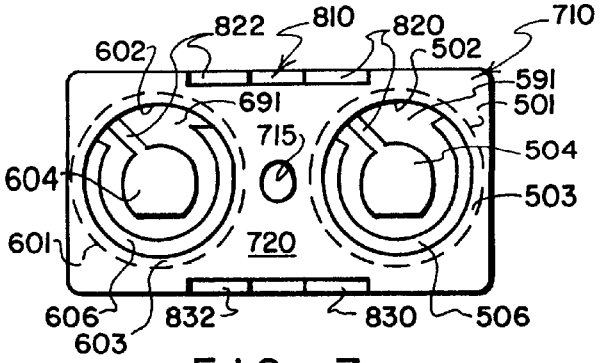
FIG. 7 is an elevational view depicting forward and rearward circuit boards of the receptacle, with the rearward board positioned behind the forward board, so that electrically conductive surfaces are shown that face forwardly into generally cylindrical passages that are defined by the housing wherein the rotors are carried, with dotted circles being provided to indicate where the housing passages overlie the circuit boards when the circuit boards are installed in hollow interior of the housing.

Major components of the receptacle 100 also include forward and rearward circuit boards 710, 810 that are housed within the hollow interior of the housing 110 near the rear wall 170. Referring to FIGS. 3 and 7, the forward board 710 has a conductive surface 720 that extends about first and second holes 502, 602 that are formed through the forward board 710 in alignment with the first and second housing passages 501, 601, with annular regions 503, 603 of the conductive surface 720 perimetrically ringing the holes 502, 602. The rearward board 810 has conductive surfaces 820, 822 that have round regions 504, 604 which are located at the centers of the holes 502, 602 when the boards 710, 810 are assembled, as depicted in FIG. 7; and has conductive surfaces 830, 832 that expose C-shaped regions 506, 606 within the passages 501, 602 when the boards 710, 810 are assembled. The conductive regions 503, 504, 506 define a first set of electrically conductive surfaces located at the rear of the first passage 501. The conductive regions 603, 604, 606 define a second set of electrically conductive surfaces located at the rear of the second passage 601.

Referring to FIG. 2, the ground screw 425 extends through aligned holes 715, 815 formed in the circuit boards 710, 810. When the screw 425 is tightened, a rear end surface 452 of the metal centerpost 450 is drawn into snug, engagement with the electrically conductive surface 820 of the forward circuit board 710 to provide a "ground" connection between the mounting bracket 410 and the electrically conductive surface 720 of the forward circuit board 710. As is best seen in FIG. 3, the centerpost 452 has hex-shaped outer surface portions 460 that are gripped by hex-shaped interior surfaces 462 of the identically configured housing halves 210, 310 to prevent rotation of the centerpost 450 relative to the housing 110 about the center axis 105; and has a circular front end region 464 that extends through a hole 465 defined at the front of the assembled housing halves 210, 310. A threaded hole 470 is provided in the front end region 464 of the centerpost 460.

Figure 11:
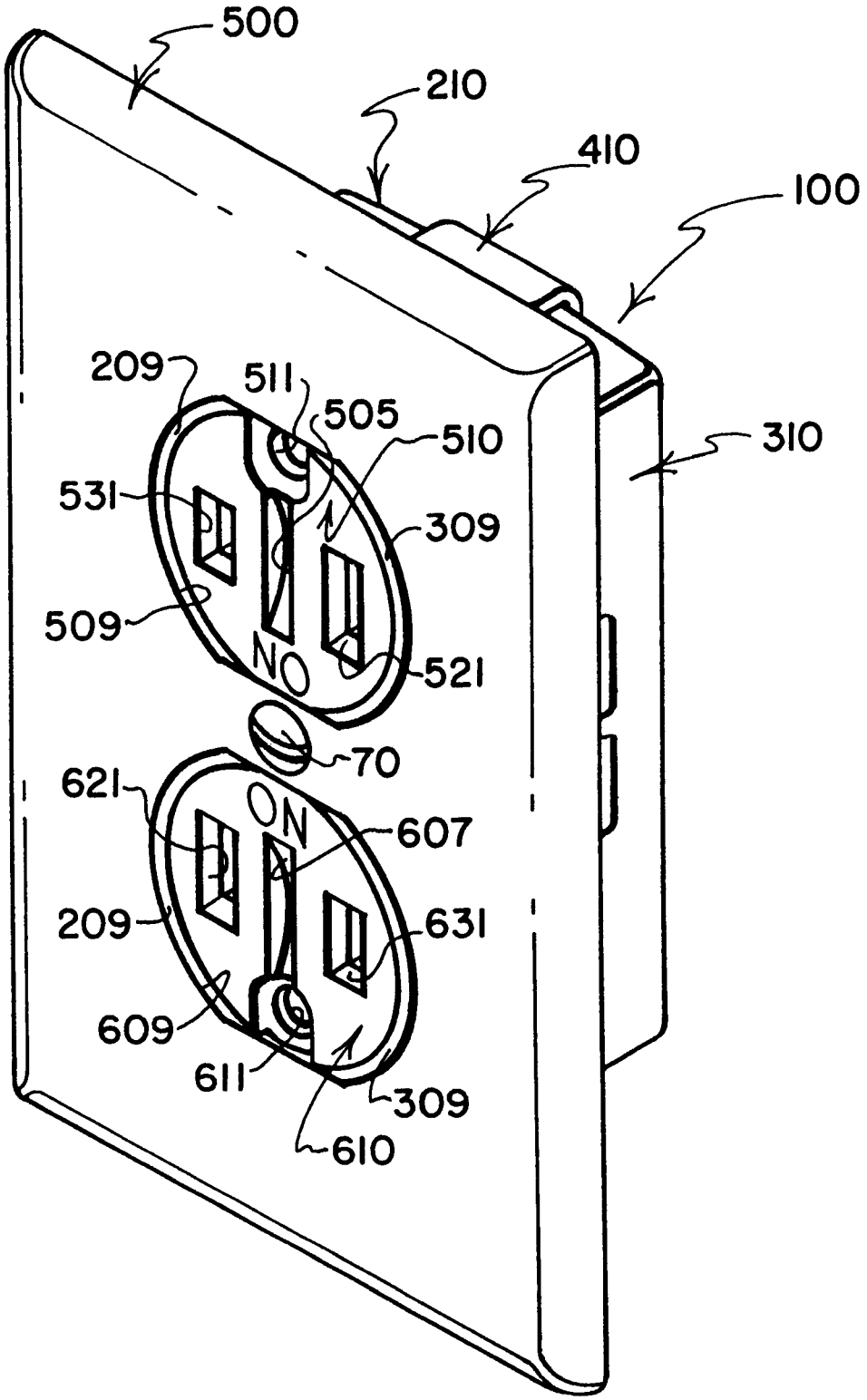

Referring to FIG. 11, a mounting screw 70 of a conventional receptacle cover plate 500 may be threaded into the centerpost hole 470 to attach the cover plate 50 to the front of the receptacle 100. Forwardly extending lips 209, 309 are defined by the left and right housing halves 210, 310 that extend into the non-circular upper and lower openings 509, 609 of the cover plate 500 to cooperate with the cover plate 500 in surrounding the circular front faces of the first and second rotors 510, 610. Through the provision of the lips 209, 309 (which fill portions of the non-circular openings 509, 609 that are not filled by the circular front faces of the rotors 510, 610), conventional cover plates, such as the depicted cover plate 500, may be used with the receptacle 100.

Other major components of the receptacle 100 include electrically conductive elements that are carried by the housing halves 210, 310. Referring to FIG. 3, left and right wire connection plates 1210, 1310 are carried by the housing halves 210, 310 at locations on opposite sides of the housing 110. The left wire connection plate 1210 carries a pair of wire connection screws 1225 and has a pair of rearwardly projecting formations 1220, 1222 that connect with the electrically conductive surfaces 820, 822 of the rearward circuit board 810. Similarly, the right wire connection plate 1310 carries a pair of wire connection screws 1325 and has a pair of rearwardly projecting formation 1330, 1332 that connect with the electrically conductive surfaces 830, 832 of the rearward circuit board 810.

Figure 4:
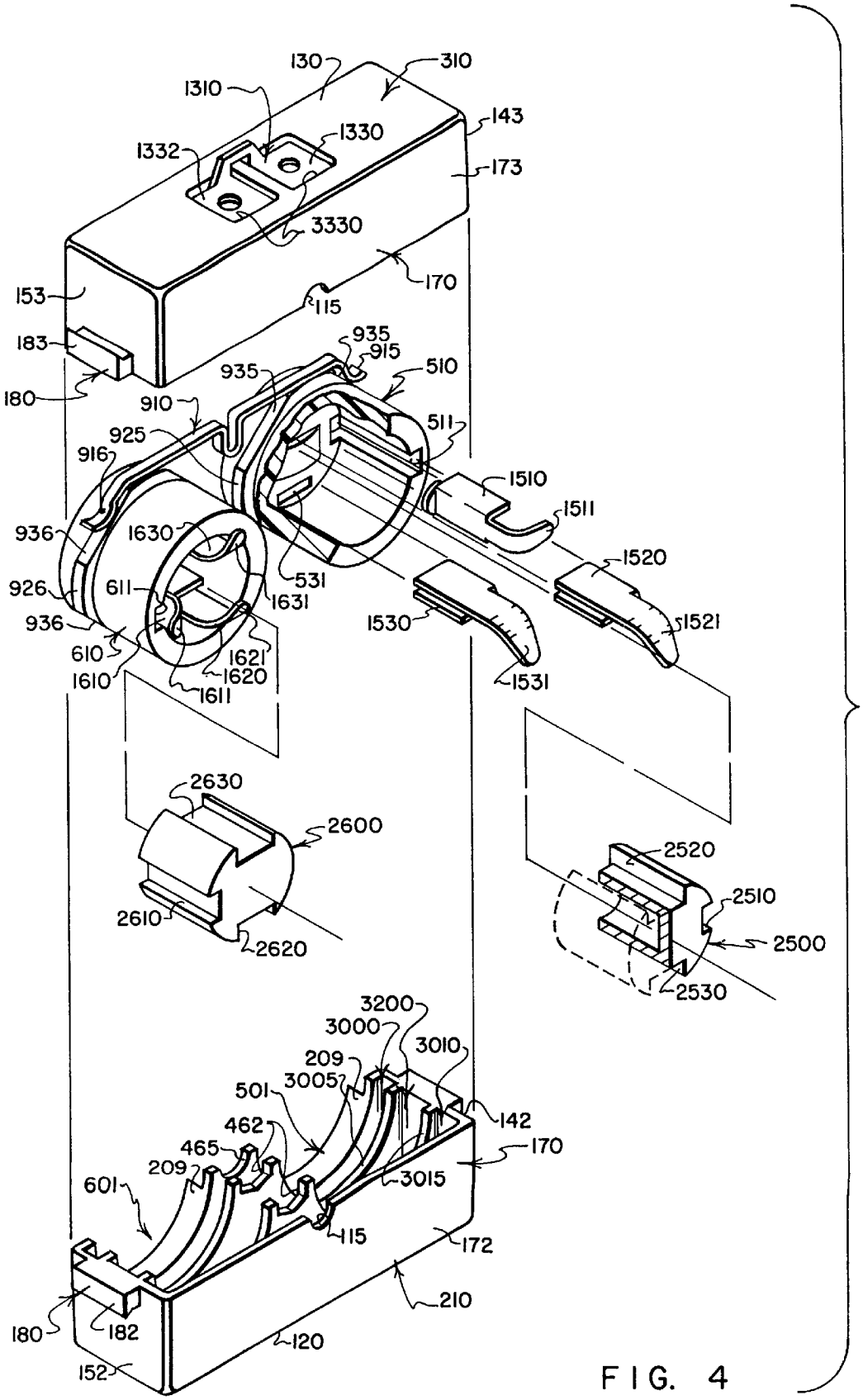
FIG. 4 is an exploded perspective view of another selection of components and subassemblies of the receptacle of FIGS. 1 and 2, with a right one of the receptacle's two rotors in the "off" orientation, and with the left one of the rotors in the "on" orientation that is depicted in FIG. 1.

Still other major components include electrically conductive elements that are carried by the first and second rotors 510, 610. Referring to FIG. 4, the first rotor 510 carries a first set of three electrical contact members 1510, 1520, 1530; and the second rotor 610 carries a second set of three electrical contact members 1610, 1620, 1630. The contact members 1510, 1520, 1530 of the first set are carried in grooves 2510, 2520, 2530 that are formed in the outer surface of a first generally cylindrical insert 2500 that is carried within the hollow interior of the first rotor 510; and, the contacts 1510, 1520, 1530 of the first set have resilient bent rear end regions 1511, 1521, 1531 that are configured to slidingly engage the first set of electrically conductive surfaces 503, 504, 506, as will be explained shortly. Similarly, the contact members 1610, 1620, 1630 of the second set are carried in grooves 2610, 2620, 2630 that are formed in the outer surface of a second generally cylindrical insert 2600 that is carried within the hollow interior of the second rotor 610; and, the contacts 1610, 1620, 1630 of the second set have resilient bent rear end regions 1611, 1621, 1631 that are configured to slidingly engage the second set of electrically conductive surfaces 603, 604, 606, as will be explained shortly.

Referring to FIGS. 1 and 3, the contact members 1510, 1520, 1530 of the first set extend into and are accessible through a first set of passages 511, 521, 531 that open through a front face of the first rotor 510. Likewise, the contact members 1610, 1620, 1630 of the second set extend into and are accessible through a second set of passages 611, 621, 631 that open through a front face of the second rotor 610. In preferred practice, 1) the passages 511, 521, 531, the grooves 2510, 2520, 2530, and the contact members 1510, 1520, 1530, and 2) the passages 611, 621, 631, the grooves 2610, 2620, 2630, and the contact members 1610, 1620, 1630, are configured and arranged to receive the projecting prongs of electrical plugs (not shown) of the type commonly used on lamps, household appliances and the like that are designed to operate in response to a supply of alternating electrical current of about 15 amps or less at a voltage within the range of about 110–120 volts, such as is typically found residential and commercial buildings in North America and elsewhere. However, as those who are skilled in the art will readily understand, the contact members 1510, 1520, 1530 and 1610, 1620, 1630 (and the passages and grooves in which they are positioned and supported) also can be configured and arranged to connect with common plug prong arrangements used in other countries and/or to deliver electrical current at other amperages and voltage ranges.

The first and second rotors 510, 610 are independently rotatable about the first and second axes 505, 605 between "on" and "off" orientations. Referring to FIG. 1, the first rotor 510 is shown rotated to an "off" orientation wherein letters "O" and "N" that are inscribed on the first rotor 510 are oriented to spell the word "NO;" and, the second rotor 610 is shown rotated to an "on" orientation wherein letters "O" and "N" that are inscribed on the second rotor 610 are oriented to spell the word "ON." Referring to FIGS. 1 and 2, coin-receiving slots 507, 607 open centrally through the front faces of the first and second rotors 510, 610 for receiving a dime coin (or a flat blade of a screwdriver or other tool, none of which are shown) to enable one to rotate the rotors 510, 610 about the axes 505, 605 between "off" and "on" orientations.

Regardless of the orientations of the rotors 510, 610, "ground" connections are always provided between the ground surface 720 of the forward circuit board 710 and the contacts 1510, 1610 (by virtue of engagements that are maintained between the rear end regions 1511, 1611 of the contacts 1510, 1610 and the surface regions 503, 603 of the conductive surface 720)—it being understood that the conductive surface 720 is electrically connected by the mounting post 450 and the ground wire connection screw 425 to the metal mounting bracket 410, and that a "ground" wire (not shown) is connected to the ground screw 425 when the receptacle 100 is installed. Likewise, regardless of the orientations of the rotors 510, 610, electrical connections are always provided between centrally located pad-like formations 504, 604 of the conductive surfaces 820, 822 of the rearward circuit board 810 and the resilient rear end regions 1521, 1621 of the contacts 1520, 1620—which are electrically connected to the left wire connection terminal 1210 carried by the left housing half 210 (a terminal to which a "white" colored "ground" wire of an electrical circuit is connected when the receptacle 100 is installed).

The contacts 1530, 1630 are switched "on" and "off" as the rotors 510, 610 are moved to "on" and "off" orientations. Depending on the orientations of the rotors 510, 610, the resilient rear end regions 1531, 1631 of the contacts 1530, 1630 may or may not engage the C-shaped regions 506, 606 of the conductive surfaces 830, 832 of the rearward circuit board 810—which are electrically connected to the right wire connection terminal 1310 carried by the right housing half 310 (a terminal to which a "black" colored "hot" wire of an electrical circuit is connected when the receptacle 100 is installed)—whereby a "switching" function is provided that serves to energize the contacts 1530, 1630 when the rotors 510, 610 are "on" oriented, and to de-energize the contacts 1530, 1630 when the rotors 510, 610 are "off" oriented. When the rotors 510, 610 are in their "off" orientations, the contact end regions 1531, 1631 engage nonconductive portions 591, 691 of the rearward circuit board 810 at locations situated between opposite ends of the C-shaped conductive regions 506, 606. The rotor 510 is in an "on" orientation when the contact end region 1531 engages the C-shaped conductive region 506; the rotor 610 is in an "on" orientation when the contact end region 1631 engages the C-shaped conductive region 606; and, the C-shaped conductive regions 506, 606 preferably are configured to be engaged by the contact end regions 1531, 1631 during "on" orientation ranges that correspond to at least one hundred eighty degrees of rotary movement of the rotors

510, 610—with the rotors 510, 610 preferably being at approximately the centers of the "on" orientation ranges when their front face letters "O" and "N" spell the word "ON" (as is exemplified by the orientation of the rotor 610 as depicted in FIG. 1).

To "detent" (i.e., to releasably retain) the first and second rotors 510, 610 in selected ones of their "off" and/or "on" orientations, a detent spring 910 (best seen in FIGS. 3 and 4) is carried within the housing 110, and is provided with rounded end regions 915, 916 that are biased toward the first and second rotors 510, 610 for engaging radially projecting flanges 925, 926 of the rotors 510, 610. Recesses or flat surface regions 935, 936 are defined by the flanges 925, 926 that are engaged by the rounded end regions 915, 916 when the rotors 510, 610 are in detented orientations. When the rotors 510, 610 are in detented orientations wherein the rounded spring ends 915, 916 engage selected ones of the recesses or flats 935, 936, the application of force that is required to reorient the rotors 510, 610 is somewhat greater than was required to complete the rotation of the rotors 510, 610 to the detented orientations inasmuch as the biasing action of the detent spring 910 tending to retain the rotors in the detented orientations must be overcome.

Other features of the preferred practice of the present invention will become apparent when the components of the receptacle 100 are examined in greater detail. Referring to FIG. 1, the housing 110 has a left side wall 120 that is defined solely by the left housing half 210, a right side wall 130 that is defined solely by the right housing half 310, an upper end wall 140 that is cooperatively defined by upper end wall portions 142, 143 of the left and right housing halves 210, 310, a lower end wall 150 that is cooperatively defined by lower end wall portions 152, 153 of the left and right housing halves 210, 310, and a front wall 160 that is cooperatively defined by left and right front wall portions 162, 163 of the left and right housing halves 210, 310. Referring to FIG. 4, left and right rear wall portions 172, 173 of the left and right housing halves 210, 310 also cooperate to define the housing's rear wall 170.

Defined on opposite ends of the housing 110 are connection formations 180 that have cross-sections (as viewed in FIG. 1) of wedge or dovetail shape. Left halves 182 of the connection formations are defined by the left housing half 210 as projections formed integrally with the left end wall portions 142, 152. Right halves 183 of the connection formations are defined by the right housing half 310 as projections formed integrally with the right end wall portions 143, 153.

Defined near the opposed end regions 420 of the mounting bracket 410 are end wall regions 480 that closely overlie the end walls 140, 150 of the housing 110. Referring to FIG. 3, slots 490 are formed through the end wall regions 480 of the mounting bracket 410 for receiving the connection formations 180 therein—and, the slots 490 have widths that are just sufficient to slide onto and grip the connection formations 180 where the wedge-shaped or dovetail-shaped cross-sections of the connections are of minimal width, whereby the tapered shapes of the connection formations 180 helps to provide connections that are reliable between the mounting bracket 410 and the housing halves 210, 310.

Figure 6:
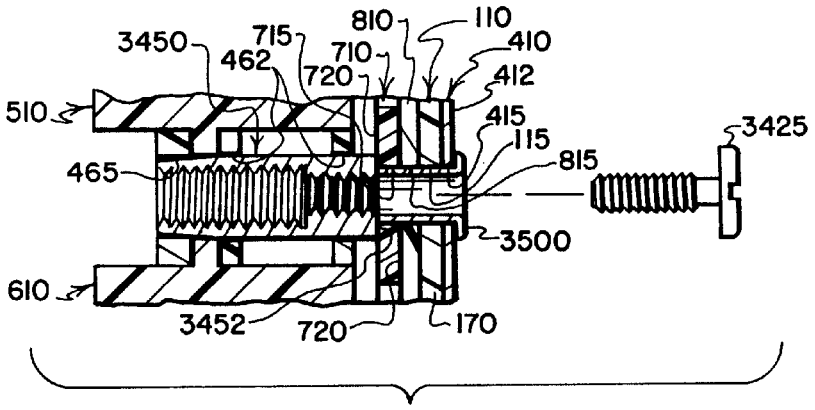
FIG. 6 is a sectional view similar to FIG. 2 showing the use of a modified centerpost that is deformed at its right end to establish a rigid connection with the metal mounting bracket of the receptacle.

Referring to FIG. 6, an alternate form of centerpost 3450 (for use in place of the centerpost 450) is depicted that can be employed to further enhance the connection of the mounting bracket 410 to other components of the receptacle 100. The centerpost 3450 has a rearwardly facing shoulder 3452 which engages and establishes electrical connection with the electrically conductive surface 720 of the forward circuit board 710, and has a rearwardly extending portion 3453 of cylindrical shape which extends through the holes 715, 815, 115, 415 (that are formed in the circuit boards 710, 810, the back wall 170 and the mounting bracket 410) to provide an end region 3454 which can be crimped, riveted or otherwise deformed to establish a rigid connection with the mounting bracket 410.

Figure 8:
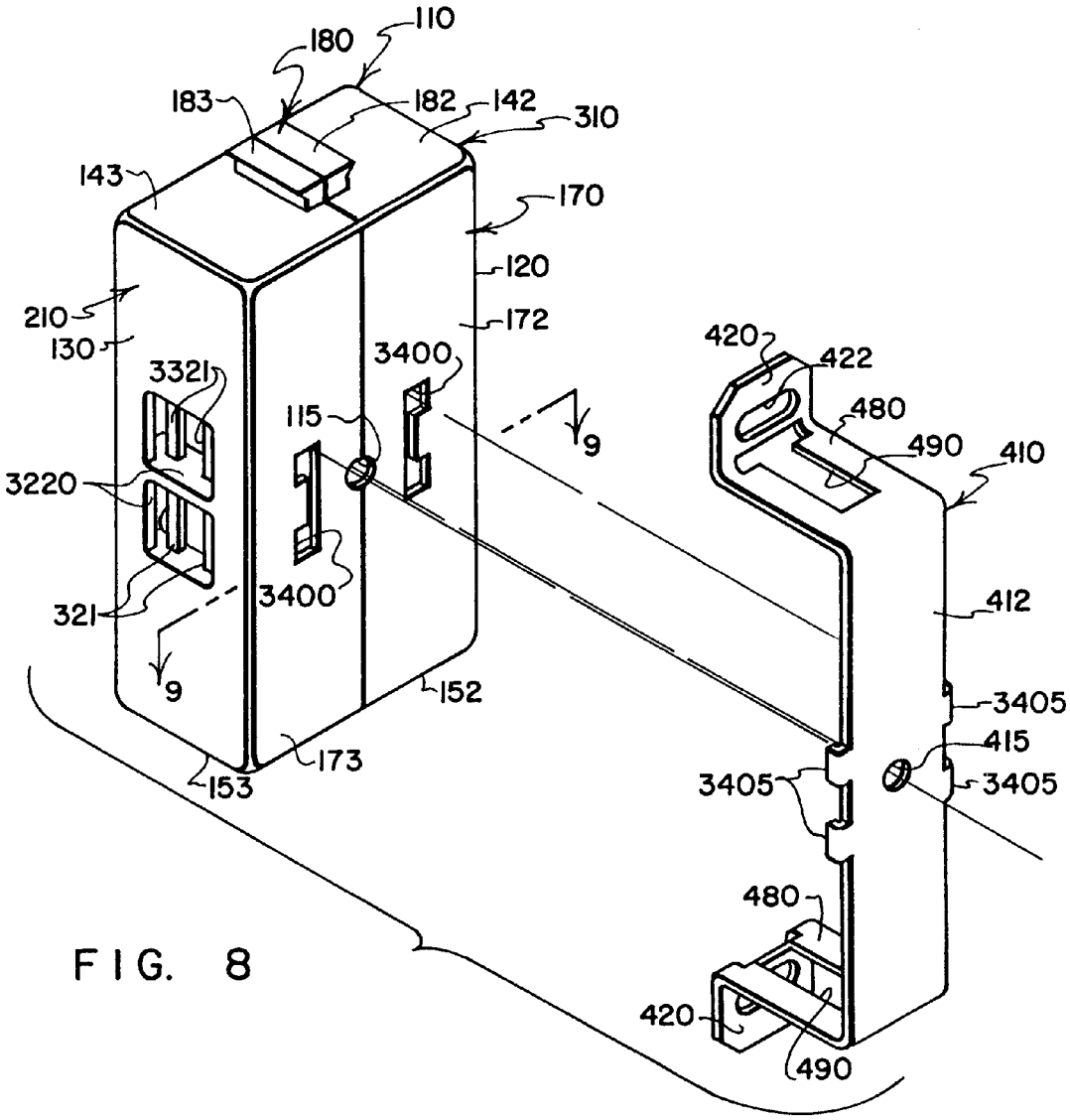
FIG. 8 is a perspective view of a modified mounting bracket provided with tab-like projections for extending into rear wall openings of modified left and right housing halves.
Figure 9:
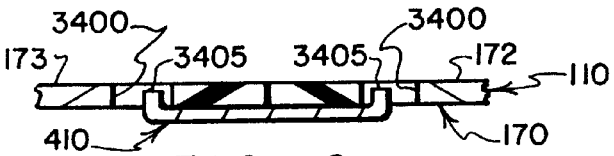
FIG. 9 is a sectional view as seen from a plane indicated by a line 9—9 in FIG. 8 showing tab-like projections of the modified mounting bracket extending into rear wall openings of the modified left and right housing halves.
Figure 10:
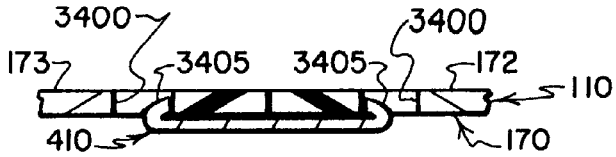
FIG. 10 is a sectional view similar to FIG. 9 showing the tab-like projections crimped to grip the housing halves; and, FIG. 11 is a perspective view showing a commercially purchased receptacle cover installed on the receptacle.

Other approaches also can be utilized to enhance the connection of the mounting bracket 410 to other components of the receptacle 100, if desired. Referring, for example, to FIGS. 8–10, openings 3400 may be formed through the back wall 170 of the housing 110 to receive tab-like projections 3405 defined on an alternate mounting bracket 3410. During assembly, the tabs 3405 are positioned to extend into the openings 3400, as depicted in FIG. 9, and then are crimped to grip the back wall 170 of the housing 110, as is depicted in FIG. 10.

Figure 5:
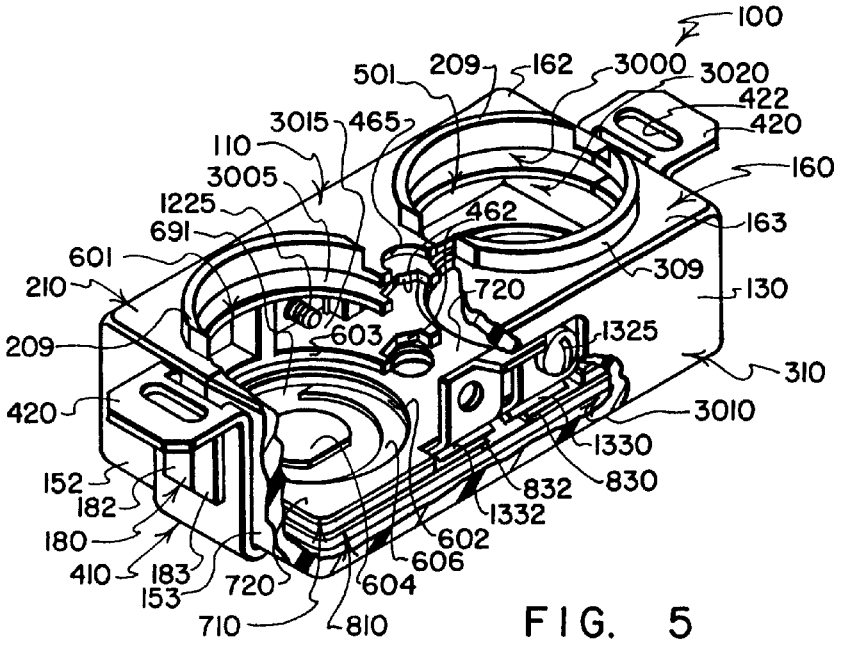
FIG. 5 is a perspective view of the receptacle of FIGS. 1–4 but with selected components including the rotors being removed, and with other components including portions of the right housing half broken away to permit interior features to be viewed.

Referring to FIGS. 3–5, the housing 110 has a hollow interior that is divided partitioned to define a relatively thin forward chamber 3000 wherein the detent spring 910 is engageable with the radially projecting flanges 925, 926 of the rotors 510, 610, a rearward chamber 3010 wherein the circuit boards 710, 810 are supported to extend in parallel planes that substantially parallel the rear wall 170 of the housing 110, and a central chamber 3020 that is separated from the forward chamber 3000 by a divider 3005, and that is separated from the rearward chamber 3010 by a divider 3015. The dividers 3005, 3015 are cooperatively defined by the left and right housing halves 210, 310.

Referring to FIGS. 3 and 8, left openings 3220 are formed through the left side wall 120 to receive the formations 1220, 1222 of the left wire connection plate 1210; and right openings 3330 are formed through the right side wall 130 to receive the formations 1330, 1332 of the right wire connection plate 1310. A pair of bar formations 3221 (formed as integral elements of the left side wall 120) extends through each of the left openings 3220, and each pair is spaced sufficiently to permit one of the wire connection screws 1225 to extend therebetween. Likewise, a pair of bar formations 3331 (formed as integral elements of the right side wall 130) extends through each of the right openings 3330, and each pair is sufficiently spaced to permit one of the wire connection screws 1325 to extend therebetween. In assembly, nuts 3333 (see FIG. 3) are carried within the hollow interior of the housing 110 and thread onto inner end regions of the screws 1225, 1325—and, when the screws 1225, 1325 are tightened, the nuts 333 cause rear surface portions of the wire connection plates 1210, 1310 to be clamped against the bar formations 3221, 3331.

While the circuit boards 710, 810 are depicted and described as comprising separate members that are supported in the rearward chamber 3010 of the housing 110, those who are skilled in the art will recognize that there are a variety of ways in which the described features and functions of these boards can be combined and simplified for large scale production. While holes 502, 602 are depicted as being formed through the forward board 710, what the holes 502, 602 define (when taken together with the forwardly-facing surface of the rearward board 810) are recesses that face forwardly into the first and second passages 501, 601—and the equivalent of these recesses can be formed in a single circuit board member (not shown) that replaces the pair of forward and rearward circuit board members 710, 810. Other modifications and simplifications in fabricating components for the receptacle 100 to expedite and minimize the cost of large scale production also will be apparent to those who are skilled in the art.

Referring to FIG. 4, the first and second rotor inserts 2500, 2600 constitute left and right mirror images of each other, and preferably are of uniform cross section along their lengths. To minimize the cost associated with fabricating the inserts 2500, 2600, these elements preferably are formed by injection molding concurrently with the molding of the rotors. Inasmuch as the main bodies of the rotors 510, 610 are of identical shape, these elements may be formed from injection molded plastic material using a common mold or using a plural cavity mold with identically configured cavities. Likewise, inasmuch as the left and right housing halves 210, 310 are of identical shape, these elements may be formed from injection molded plastic material using a common mold or using a plural cavity mold with identically configured cavities.

The contacts 1510, 1610 are identical, and preferably are stamped from copper or other suitable electrically conductive metal. The contacts 1521, 1621 are identical, and preferably are stamped from copper or other suitable electrically conductive metal. The contacts 1531, 1631 are identical, and preferably are stamped from copper or other suitable electrically conductive metal. The wire connection plates 1210, 1310 are identical, and preferably are stamped from copper or other suitable electrically conductive metal. The centerpost 450 and the mounting bracket 410 preferably are formed from steel or other suitable electrically conductive metal.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. An electrical receptacle, comprising:

a) a housing defined by substantially identical left and right housing halves formed from nonconductive material which, when positioned in side-by-side assembly, cooperate to define a hollow housing interior bordered by a left side wall that is defined by the left housing half, by a right side wall that is defined by the right housing half, and by a front wall, a rear wall and opposed end walls that are cooperatively defined by the left and right housing halves, and wherein first and second substantially parallel extending passages are defined within the hollow housing interior and open through the front wall;

b) mounting means for connection to each of the left and right housing halves for retaining the housing halves in said side-by-side assembly, and for mounting the housing in an electrical connection box;

c) circuit board means for defining a thin, substantially flat nonconductive member configured to be carried within the hollow housing interior closely overlying the rear wall of the housing, for defining a first set of three electrically conductive surfaces on the nonconductive member that face forwardly at the rear of the first passage, for defining a second set of three electrically conductive surfaces on the nonconductive member that face forwardly at the rear of the second passage, and for defining connection portions of the electrically conductive surfaces of the first and second sets that extend to connection locations of the nonconductive member that are not aligned with the first and second passages;

d) first rotor means for being journaled within the first passage for rotation relative to the housing between an off orientation of the first rotor means and a plurality of on orientations of the first rotor means, and for including nonconductive material which defines a front face through which a first set of three contact-receiving passages open in an arrangement configured to permit three metal prongs of a first electrical plug to be received therein;

e) second rotor means for being journaled within the second passage for rotation relative to the housing between an off orientation of the second rotor means and a plurality of on orientations of the second rotor means, and for including nonconductive material which defines a front face through which a second set of three contact-receiving passages open in an arrangement configured to permit three metal prongs of a second electrical plug to be received therein;

f) first rotor contact means for defining a first set of three rotor contacts for being connected to and rotated with the first rotor means, wherein:

1) each of the three rotor contacts of the first set of three rotor contacts is configured to extend into a separate one of the three contact-receiving passages of the first set of three contact-receiving passages for engaging and establishing electrical connection with a separate one of the prongs of the first electrical plug when the prongs of the first electrical plug are received within the first set of three contact-receiving passages;

2) a selected first one of the three rotor contacts of the first set of three rotor contacts is configured to extend rearwardly within the first passage of the housing i) to engage and establish electrical connection with a selected first one of the three electrically conductive surfaces of the first set of three electrically conductive surfaces when the first rotor means is in any of the on orientations of the first rotor means, and ii) to disengage the selected first one of the three electrically conductive surfaces of the first set of three electrically conductive surfaces when the first rotor means is in the off orientation of the first rotor means;

3) a selected second one of the three rotor contacts of the first set of three rotor contacts is configured to extend rearwardly within the first passage of the housing to engage and establish electrical connection with a selected second one of the three electrically conductive surfaces of the first set of three electrically conductive surfaces when the first rotor means is in any of the off and on orientations of the first rotor means; and, 4) a selected third one of the three rotor contacts of the first set of three rotor contacts is configured to extend rearwardly within the first passage of the housing to engage and establish electrical connection with a selected third one of the three electrically conductive surfaces of the first set of three electrically conductive surfaces when the first rotor means is in any of the on orientations of the first rotor means;

g) second rotor contact means for defining a second set of three rotor contacts for being connected to and rotated with the second rotor means, wherein:

1) each of the three rotor contacts of the second set of three rotor contacts is configured to extend into a separate one of the three contact-receiving passages of the second set of three contact-receiving passages for engaging and establishing electrical connection with a separate one of the prongs of the second electrical plug when the prongs of the second electrical plug are received within the second set of three contact-receiving passages;

2) a selected first one of the three rotor contacts of the second set of three rotor contacts is configured to extend rearwardly within the second passage of the housing i) to engage and establish electrical connection with a selected first one of the three electrically conductive surfaces of the second set of three electrically conductive surfaces when the second rotor means is in any of the on orientations of the second rotor means, and ii) to disengage the selected first one of the three electrically conductive surfaces of the second set of three electrically conductive surfaces when the second rotor means is in the off orientation of the second rotor means;

3) a selected second one of the three rotor contacts of the second set of three rotor contacts is configured to extend rearwardly within the second passage of the housing to engage and establish electrical connection with a selected second one of the three electrically conductive surfaces of the second set of three electrically conductive surfaces when the second rotor means is in any of the off and on orientations of the second rotor means; and, 4) a selected third one of the three rotor contacts of the first set of three rotor contacts is configured to extend rearwardly within the second passage of the housing to engage and establish electrical connection with a selected third one of the three electrically conductive surfaces of the second set of three electrically conductive surfaces when the second rotor means is in any of the on orientations of the second rotor means; and, h) electrical connection means connected to the housing for engaging the connection portions of the electrically conductive surfaces of the first and second sets of electrically conductive surfaces at said connection locations for selectively connecting the electrically conductive surfaces of the first and second sets to ground and to a source of electrical energy.

2. The electrical receptacle of claim 1 wherein:

a) the selected first one of the three rotor contacts of the first set of three rotor contacts is configured to disengage and establish no electrical connection with any of the three electrically conductive surfaces of the first set of three electrically conductive surfaces when the first rotor means is in the off orientation of the first rotor means; and, b) the selected first one of the three rotor contacts of the second set of three rotor contacts is configured to disengage and establish no electrical connection with any of the three electrically conductive surfaces of the second set of three electrically conductive surfaces when the second rotor means is in the off orientation of the second rotor means.

3. The electrical receptacle of claim 1 wherein:

a) the selected third one of the three rotor contacts of the first set of three rotor contacts is configured to engage and establish electrical connection with the selected third one of the three electrically conductive surfaces of the first set of three electrically conductive surfaces regardless of the orientation of the first rotor means; and, b) the selected third one of the three rotor contacts of the second set of three rotor contacts is configured to engage and establish electrical connection with the selected third one of the three electrically conductive surfaces of the second set of three electrically conductive surfaces regardless of the orientation of the second rotor means.

4. The electrical receptacle of claim 1 wherein:

a) the opposed end walls of the housing include an upper end wall that is cooperatively defined by an upper end wall portion of the left housing half and an upper end wall portion of the right housing half, and a lower end wall that is cooperatively defined by a lower end wall portion of the left housing half and a lower end wall portion of the right housing half;

b) upper connection formations are defined by the upper end wall portion of the left housing half and by the upper end wall portion of the right housing half, and lower connection formations are defined by the lower end wall portion of the left housing half and by the lower end wall portion of the right housing half; arid, c) the mounting means includes upper connection means for engaging the upper connection formations and lower connection means for engaging the lower connection formations for retaining the left and right housing halves in side-by-side assembly.

5. The electrical receptacle of claim 4 wherein:

a) the mounting means includes an elongate metal mounting bracket that extends substantially the full length of the housing and has an upper end region that extends along at least parts of the upper end wall portions of each of the left and right housing halves, and a lower end region that extends along at least parts of the lower end wall portions of each of the left and right housing halves; and, b) the upper connection means includes an upper connection device provided on the upper end region of the mounting bracket for receiving and gripping the upper connection formations, and a lower connection device provided on the lower end region of the mounting bracket for receiving and gripping the lower connection formations.

6. The electrical receptacle of claim 5 wherein:

a) the upper connection device includes an upper slot formed through the upper end region of the elongate metal mounting bracket between upper region bracket portions that define opposite sides of the upper slot, with the opposite sides of the upper slot defining an upper slot width that will receive the upper connection formations therein with the upper bracket portions gripping the upper connection formations to assist in retaining the housing halves in said side-by-side assembly; and, b) the lower connection device includes a lower slot formed through the lower end region of the elongate metal mounting bracket between lower region bracket portions that define opposite sides of the lower slot, with the opposite sides of the lower slot defining a lower slot width that will receive the lower connection formations therein with the lower bracket portions gripping the lower connection formations to assist in retaining the housing halves in said side-by-side assembly.

7. The electrical receptacle of claim 6 wherein:

a) the first rotor means is rotatable relatively to the housing about an imaginary first axis that extends substantially centrally through the first passage, the second rotor means is rotatable relative to the housing about an imaginary second axis that extends substantially centrally through the second passage, the first and second axes are substantially parallel, and an imaginary central axis of the housing that parallels the first and second axes is defined at a location substantially midway between the first and second axes;

b) the upper connection formations of the left and right housing halves extend in side-by-side engagement when the left and right housing halves are in said side-by-side assembly and cooperate to define left and right halves of an upper end projection which has a wedge shaped cross section that increases in width as it extends away from central axis;

c) the lower connection formations of the left and right housing halves extend in side-by-side engagement when the left and right housing halves are in said side-by-side assembly and cooperate to define left and right halves of a lower end projection which has a wedge shaped cross section that increases in width as it extends away from central axis;

d) the upper bracket portions grip the upper end projection at a location where the wedge shaped cross section of the upper end projection is of minimal width; and, e) the lower bracket portions grip the lower end projection at a location where the wedge shaped cross section of the lower end projection is of minimal width.

8. The electrical receptacle of claim 1 wherein:

a) the first rotor means is rotatable relatively to the housing about an imaginary first axis that extends substantially centrally through the first passage, the second rotor means is rotatable relative to the housing about an imaginary second axis that extends substantially centrally through the second passage, the first and second axes are substantially parallel, an imaginary central axis of the housing parallels the first and second axes at a location that is substantially midway between the first and second axes, and a hole is formed in the rear wall of the housing where the central axis intersects therewith;

b) the mounting means includes an elongate metal mounting bracket that extends exteriorly along the rear wall of the housing and has a hole formed therethrough at a location where the central axis of the housing intersects therewith;

c) the circuit board means has a central region that extends substantially perpendicular to the central axis, has an electrically conductive surface that covers the central region and connects electrically with a chosen one of the electrically conductive surfaces of the first and second sets that is to be connected to ground, and has a hole formed therethrough at a location where the central axis intersects with the electrically conductive surface that covers the central region;

d) metal centerpost means for being positioned within the hollow interior of the housing and for defining a rearwardly facing surface that is engageable with the electrically conductive surface that covers the central region is provided; and, e) clamping means is provided for extending through the holes formed through the mounting bracket, the rear wall of the housing and the central region of the circuit board means for clamping the rearwardly facing surface of the metal centerpost means into electrically conductive engagement with the electrically conductive surface that covers the central region, and for establishing electrical connection between the metal centerpost means and the metal mounting bracket whereby, when the metal mounting bracket is connected to ground, the metal centerpost means and the electrically conductive surface that covers the central region also are connected to ground.

9. The electrical receptacle of claim 8 wherein the clamping means includes a screw that extends through the holes formed through the mounting bracket, the rear wall of the housing and the central region of the circuit board means, that threads into a threaded hole formed in the metal centerpost means, and has an enlarged head configured to clampingly engage the mounting bracket when the screw is tightened in place by threading it into the threaded hole.

10. The electrical receptacle of claim 8 wherein the clamping means includes a rearwardly extending portion of the metal centerpost means configured a) to extend through the holes formed in the central region of the circuit board means, the rear wall of the housing and the mounting bracket, and b) to be deformed adjacent the mounting bracket for establishing a rigid connection between the metal centerpost means and the mounting bracket.

11. The electrical receptacle of claim 8 wherein the front wall of the housing has a hole formed therethrough at a location where the central axis of the housing intersects therewith, wherein the metal centerpost means has a front end region that extends into the hole formed through the front wall of the housing, and the front end region of the metal centerpost means is provided with a threaded hole that extends along the central axis for receiving a screw to mount a conventional receptacle coverplate on the front of the receptacle.

12. The electrical receptacle of claim 8 wherein the metal centerpost means has an exterior surface region that is of hex-shaped cross-section, and the hollow interior of the housing is provided with formation means cooperatively defined by the left and right housing halves for engaging the region of hex-shaped cross-section for preventing rotation of the metal centerpost means relative to the housing when the left and right housing halves are in said side-by-side assembly.

13. The electrical receptacle of claim 1 wherein the electrical connection means includes:

a) left wire connection means connected to the left housing half for establishing electrical connection with a first one of the electrically conductive surfaces of each of the first and second sets of electrically conductive surfaces at one of said connection locations; and, b) right wire connection means connected to the right housing half for establishing electrical connection with a second one of the electrically conductive surfaces of each of the first and second sets of electrically conductive surfaces at another of said connection locations.

14. The electrical receptacle of claim 1 wherein:

a) the circuit board means defines a first forwardly facing recess of generally cylindrical configuration which is located at the rear of the first passage, and a second forwardly facing recess of generally cylindrical configuration which is located at the rear of the second passage;

b) a chosen first one of the three electrically conductive surfaces of the first set of three electrically conductive surfaces includes a first annular conductive portion that extends in an uninterrupted ring about the circumference of the first recess, and a chosen first one of the three electrically conductive surfaces of the second set of three electrically conductive surfaces includes a second annular conductive portion that extends in an uninterrupted ring about the circumference of the second recess;

c) a chosen second one of the three electrically conductive surfaces of the first set of three electrically conductive surfaces includes a first round conductive portion that is located substantially centrally within the first recess, and a chosen second one of the three electrically conductive surfaces of the second set of three electrically conductive surfaces includes a second round conductive portion that is located substantially centrally within the second recess; and, d) a chosen third one of the three electrically conductive surfaces of the first set of three electrically conductive surfaces includes a first C-shaped portion that is provided within the first recess and wraps about the first round conductive portion at a distance spaced therefrom, and a chosen third one of the three electrically conductive surfaces of the second set of three electrically conductive surfaces includes a second C-shaped portion that is provided within the second recess and wraps about the second round conductive portion at a distance spaced therefrom.

15. The electrical receptacle of claim 14 wherein the first and second annular conductive portions, the first and second round conductive portions, and the first and second C-shaped portions all extend within substantially parallel planes.

16. The electrical receptacle of claim 15 wherein more than half of the rear wall of the housing is substantially flat and extends substantially parallel to said substantially parallel planes.

17. The electrical receptacle of claim 15 wherein the first and second annular conductive portions extend in a first common plane defined by portions of the circuit board means that surround the first and second recesses, and the first round conductive portion, the second round conductive portion, the first C-shaped portion and the second C-shaped portion extend in a second common plane defined by portions of the circuit board means located within the first and second recesses.

18. The electrical receptacle of claim 1 additionally including biasing means carried by the housing for releasably engaging detent formation means defined by the first rotor means and by the second rotor means for releasably retaining the first rotor means in at least a selected one of the off and on orientations of the first rotor means, and for releasably retaining the second rotor means in at least a selected one of the off and on orientations of the second rotor means.

19. The electrical receptacle of claim 18 wherein the biasing means includes an elongate leaf spring having rounded formations located near opposite ends thereof, wherein at least a selected one of the right and left housing halves defines a chamber within the hollow housing interior that opens into the first and second passages wherein the leaf spring is supported such that each of the rounded formations thereof is biased toward a separate one of the first and second passages, and wherein the detent formation means includes exterior surface formations provided on the first and second rotor means for being engaged by the rounded formations when the first and second rotor means are in the selected orientations.

20. The electrical receptacle of claim 19 wherein the first and second rotor means define radially projecting flange portions that extend into said chamber, and the flange portions define the exterior surface formations that are engaged by the rounded formations when the first and second rotor means are in the selected orientations.

21. The electrical receptacle of claim 20 wherein:

a) the first rotor means includes a first main rotor member having a first front wall portion of the first main rotor member that cooperates with a first tubular body portion of the first main rotor member which extends rearwardly from the first front wall portion to define a first hollow interior, and first insert means for extending into the first hollow interior and for cooperating with the first main rotor member to define the first set of three contact-receiving passages; and, b) the second rotor means includes a second main rotor member having a second front wall portion of the second main rotor member that cooperates with a second tubular body portion of the second main rotor member which extends rearwardly from the second front wall portion to define a second hollow interior, and second insert means for extending into the second hollow interior and for cooperating with the second main rotor member to define the second set of three contact-receiving passages.

22. The receptacle of claim 21 wherein:

a) the first insert means includes a first insert member having a generally cylindrical outer surface with first groove means opening therethrough for cooperating with interior formations of the first main rotor member to connect the first set of three rotor contacts to the first rotor means for rotation therewith relative to the housing; and, b) the second insert means includes a second insert member having a generally cylindrical outer surface with second groove means opening therethrough for cooperating with interior formations of the second main rotor member to connect the second set of three rotor contacts to the second rotor means for rotation therewith relative to the housing.

23. The electrical receptacle of claim 1 wherein the front face of the first rotor means and the front face of the second rotor means are of circular shape, and wherein the housing means defines forwardly projecting lip formations for cooperating with the circular front faces of the first and second rotor means to extend into and to substantially fill first and second non-circular openings that are defined by a commercially available receptacle cover plate when the cover plate is installed on the receptacle.

24. An electrical receptacle, comprising:

a) a housing defined by substantially identical left and right housing halves formed from nonconductive material which, when positioned in side-by-side assembly, cooperate to define a hollow housing interior bordered by a left side wall that is defined by the left housing half, by a right side wall that is defined by the right housing half, by an upper end wall that is cooperatively defined by an upper end wall portion of the left housing half and an upper end wall portion of the right housing half, by a lower end wall that is cooperatively defined by a lower end wall portion of the left housing half and a lower end wall portion of the right housing half, and by a front wall and a rear wall that are cooperatively defined by the left and right housing halves, and wherein first and second substantially parallel extending passages are defined within the hollow housing interior and open through the front wall;

b) mounting means for connection to each of the left and right housing halves for retaining the housing halves in said side-by-side assembly including a metal mounting bracket that defines upper connection means for engaging upper connection formations that are defined by the upper end wall portions of the left and right housing halves, and lower connection means for engaging lower connection formations that are defined by the lower end wall portions of the left and right housing halves;

c) circuit board means for defining a thin, substantially flat nonconductive member configured to be carried within the hollow housing interior closely overlying the rear wall of the housing, for defining a first set of electrically conductive surfaces on the nonconductive member that face forwardly at the rear of the first passage, and for defining a second set of electrically conductive surfaces on the nonconductive member that face forwardly at the rear of the second passage;

d) first rotor means for being journaled within the first passage for rotation relative to the housing between off and on orientations of the first rotor means and for defining a first set of contact-receiving passages arranged to permit metal prongs of a first electrical plug to be received therein;

e) second rotor means for being journaled within the second passage for rotation relative to the housing between off and on orientations of the second rotor means and for defining a second set of contact-receiving passages arranged to permit metal prongs of a second electrical plug to be received therein;

f) first rotor contact means for defining a first set of rotor contacts for being connected to and rotated with the first rotor means 1) for extending into the first set of contact-receiving passages to engage and establish electrical connection with the metal prongs of the first plug when the metal prongs of the first plug are received therein, and 2) for selectively engaging the first set of electrically conductive surfaces for transferring electrical energy from the first set of electrically conductive surfaces to the first set of rotor contacts when the first rotor means is oriented in the on orientation of the first rotor means but not when the first rotor means is oriented in the off orientation of the first rotor means; and, g) second rotor contact means for defining a second set of rotor contacts for being connected to and rotated with the second rotor means 1) for extending into the second set of contact-receiving passages to engage and establish electrical connection with the metal prongs of the second plug when the metal prongs of the second plug are received therein, and 2) for selectively engaging the second set of electrically conductive surfaces for transferring electrical energy from the second set of electrically conductive surfaces to the second set of rotor contacts when the second rotor means is oriented in the on orientation of the second rotor means but not when the second rotor means is oriented in the off orientation of the second rotor means.

25. The receptacle of claim 24 wherein:

a) the metal mounting bracket is of elongate configuration and has spaced upper and lower end regions;

b) the upper connection means includes an upper slot formed through the upper end region of the elongate metal mounting bracket between upper region bracket portions that define opposite sides of the upper slot, with the opposite sides of the upper slot defining an upper slot width that will receive the upper connection formations therein with the upper bracket portions gripping the upper connection formations to assist in retaining the housing halves in said side-by-side assembly; and, c) the lower connection means includes a lower slot formed through the lower end region of the elongate metal mounting bracket between lower region bracket portions that define opposite sides of the lower slot, with the opposite sides of the lower slot defining a lower slot width that will receive the lower connection formations therein with the lower bracket portions gripping the lower connection formations to assist in retaining the housing halves in said side-by-side assembly.

26. The electrical receptacle of claim 25 wherein:

a) the first rotor means is rotatable relatively to the housing about an imaginary first axis that extends substantially centrally through the first passage, the second rotor means is rotatable relative to the housing about an imaginary second axis that extends substantially centrally through the second passage, the first and second axes are substantially parallel, and an imaginary central axis of the housing that parallels the first and second axes is defined at a location substantially midway between the first and second axes;

b) the upper connection formations of the left and right housing halves extend in side-by-side engagement when the left and right housing halves are in said side-by-side assembly and cooperate to define left and right halves of an upper end projection which has a wedge shaped cross section that increases in width as it extends away from central axis;

c) the lower connection formations of the left and right housing halves extend in side-by-side engagement when the left and right housing halves are in said side-by-side assembly and cooperate to define left and right halves of a lower end projection which has a wedge shaped cross section that increases in width as it extends away from central axis;

d) the upper bracket portions grip the upper end projection at a location where the wedge shaped cross section of the upper end projection is of minimal width; and, e) the lower bracket portions grip the lower end projection at a location where the wedge shaped cross section of the lower end projection is of minimal width.

27. The electrical receptacle of claim 24 wherein:

a) the first rotor means is rotatable relatively to the housing about an imaginary first axis that extends substantially centrally through the first passage, the second rotor means is rotatable relative to the housing about an imaginary second axis that extends substantially centrally through the second passage, the first and second axes are substantially parallel, an imaginary central axis of the housing parallels the first and second axes at a location that is substantially midway between the first and second axes, and a hole is formed in the rear wall of the housing where the central axis intersects therewith;

b) the mounting bracket has a portion that extends exteriorly along the rear wall of the housing and has a hole formed therethrough at a location where the central axis of the housing intersects therewith;

c) the circuit board means has a central region that extends substantially perpendicular to the central axis, has an electrically conductive surface that covers the central region and connects electrically with a chosen one of the electrically conductive surfaces of the first and second sets, and has a hole formed therethrough at a location where the central axis intersects with the electrically conductive surface that covers the central region;

d) metal centerpost means for being positioned within the hollow interior of the housing and for defining a rearwardly facing surface that is engageable with the electrically conductive surface that covers the central region is provided; and, e) clamping means is provided for extending through the holes formed through the mounting bracket, the rear wall of the housing and the central region of the circuit board means for clamping the rearwardly facing surface of the metal centerpost means into electrically conductive engagement with the electrically conductive surface that covers the central region, and for establishing electrical connection between the metal centerpost means and the metal mounting bracket.

28. The electrical receptacle of claim 27 wherein the clamping means includes a screw that extends through the holes formed through the mounting bracket, the rear wall of the housing and the central region of the circuit board means, that threads into a threaded hole formed in the metal centerpost means, and has an enlarged head configured to clampingly engage the mounting bracket when the screw is tightened in place by threading it into the threaded hole.

29. The electrical receptacle of claim 27 wherein the clamping means includes a rearwardly extending portion of the metal centerpost means configured a) to extend through the holes formed in the central region of the circuit board means, the rear wall of the housing and the mounting bracket, and b) to he deformed adjacent the mounting bracket for establishing a rigid connection between the metal centerpost means and the mounting bracket.

30. The electrical receptacle of claim 27 wherein the metal centerpost means has an exterior surface region that is of hex-shaped cross-section, and the hollow interior of the housing is provided with formation means cooperatively defined by the left and right housing halves for engaging the region of hex-shaped cross-section for preventing rotation of the metal centerpost means relative to the housing when the left and right housing halves are in said side-by-side assembly.

31. The electrical receptacle of claim 24 additionally including:

a) left wire connection means connected to the left housing half for establishing electrical connection with a first one of the electrically conductive surfaces of each of the first and second sets of electrically conductive surfaces; and, b) right wire connection means connected to the right housing half for establishing electrical connection with a second one of the electrically conductive surfaces of each of the first and second sets of electrically conductive surfaces.

32. The electrical receptacle of claim 24 wherein:

a) the first rotor means includes a first main rotor member having a first front wall portion of the first main rotor member that cooperates with a first tubular body portion of the first main rotor member which extends rearwardly from the first front wall portion to define a first hollow interior, and first insert means for extending into the first hollow interior and for cooperating with the first main rotor member to define the first set of three contact-receiving passages; and, b) the second rotor means includes a second main rotor member having a second front wall portion of the second main rotor member that cooperates with a second tubular body portion of the second main rotor member which extends rearwardly from the second front wall portion to define a second hollow interior, and second insert means for extending into the second hollow interior and for cooperating with the second main rotor member to define the second set of three contact-receiving passages.

33. The receptacle of claim 32 wherein:

a) the first insert means includes a first insert member having a generally cylindrical outer surface with first groove means opening therethrough for cooperating with interior formations of the first main rotor member to connect the first set of three rotor contacts to the first rotor means for rotation therewith relative to the housing; and, b) the second insert means includes a second insert member having a generally cylindrical outer surface with second groove means opening therethrough for cooperating with interior formations of the second main rotor member to connect the second set of three rotor contacts to the second rotor means for rotation therewith relative to the housing.

34. The electrical receptacle of claim 24 wherein the front face of the first rotor means and the front face of the second rotor means are of circular shape, and wherein the housing defines forwardly projecting lip formations for cooperating with the circular front faces of the first and second rotor means to extend into and to substantially fill first and second noncircular openings that are defined by a commercially available receptacle cover plate when the cover plate is installed on the receptacle.

35. An electrical receptacle, comprising:

a) a housing defined by substantially identical left and right housing halves formed from nonconductive material which, when positioned in side-by-side assembly, cooperate to define a hollow housing interior bordered by a left side wall that is defined by the left housing half, by a right side wall that is defined by the right housing half, and by a front wall, a rear wall and opposed end walls that are cooperatively defined by the left and right housing halves, and wherein first and second substantially parallel extending passages are defined within the hollow housing interior and open through the front wall, with the left and right housing halves also cooperating to define within the hollow housing interior a forward chamber that extends perimetrically about and opens into each of the first and second passages, and a rearward chamber that extends perimetrically about and opens into each of the first and second passages at the rear of the hollow housing interior;

b) mounting means for connection to each of the left and right housing halves for retaining the housing halves in said side-by-side assembly;

c) circuit board means for defining a thin, substantially flat nonconductive member configured to be carried within the rearward chamber of the hollow housing interior closely overlying the rear wall of the housing, for defining a first set of electrically conductive surfaces on the nonconductive member that face forwardly at the rear of the first passage, and for defining a second set of electrically conductive surfaces on the nonconductive member that face forwardly at the rear of the second passage;

d) first rotor means for being journaled within the first passage for rotation relative to the housing between off and on orientations of the first rotor means and for defining a first set of contact-receiving passages arranged to permit metal prongs of a first electrical plug to be received therein, with the first rotor means including first radially extending flange means for extending radially outwardly into the forward chamber for cooperating with the housing to retain the first rotor means within the first passage;

e) second rotor means for being journaled within the second passage for rotation relative to the housing between off and on orientations of the second rotor means and for defining a second set of contact-receiving passages arranged to permit metal prongs of a second electrical plug to be received therein, with the second rotor means including second radially extending flange means for extending radially outwardly into the forward chamber for cooperating with the housing to retain the second rotor means within the second passage;

f) first rotor contact means for defining a first set of rotor contacts for being connected to and rotated with the first rotor means 1) for extending into the first set of contact-receiving passages to engage and establish electrical connection with the metal prongs of the first plug when the metal prongs of the first plug are received therein, and 2) for selectively engaging the first set of electrically conductive surfaces for transferring electrical energy from the first set of electrically conductive surfaces to the first set of rotor contacts when the first rotor means is oriented in the on orientation of the first rotor means but not when the first rotor means is oriented in the off orientation of the first rotor means; and, g) second rotor contact means for defining a second set of rotor contacts for being connected to and rotated with the second rotor means 1) for extending into the second set of contact-receiving passages to engage and establish electrical connection with the metal prongs of the second plug when the metal prongs of the second plug are received therein, and 2) for selectively engaging the second set of electrically conductive surfaces for transferring electrical energy from the second set of electrically conductive surfaces to the second set of rotor contacts when the second rotor means is oriented in the on orientation of the second rotor means but not when the second rotor means is oriented in the off orientation of the second rotor means.

36. The electrical receptacle of claim 35 additionally including biasing means for being positioned within the forward chamber for engaging the first radially extending flange means for releasably retaining the first rotor means in at least a selected one of the off and on orientations of the first rotor means, and for engaging the second radially extending flange means for releasably retaining the second rotor means in at least a selected one of the off and on orientations of the second rotor means.

37. The electrical receptacle of claim 36 wherein the biasing means includes an elongate leaf spring that defined first and second rounded formations near opposite ends thereof, with the first rounded formation being configured to engage the first radially extending flange means when the first rotor means is in said at least one selected off and on orientation of the first rotor means to releasably retain the first rotor means therein, and with the second rounded formation being configured to engage the second radially extending flange means when the second rotor means is in said at least one selected off and on orientation of the second rotor means to releasably retain the second rotor means therein.

38. The electrical receptacle of claim 35 wherein the front face of the first rotor means and the front face of the second rotor means are of circular shape, and wherein the housing defines forwardly projecting lip formations for cooperating with the circular front faces of the first and second rotor means to extend into and to substantially fill first and second noncircular openings that are defined by a commercially available receptacle cover plate when the cover plate is installed on the receptacle.

39. An electrical receptacle, comprising:

a) an elongate housing formed from nonconductive material and having front and rear walls that are connected to opposed end walls and to opposed left and right side walls that cooperate to define a hollow interior of the housing where interior formations are provided that cooperate to define first and second passages of the housing that are of generally cylindrical configuration and open through the front wall;

b) wherein a majority of the housing is defined by two substantially identical parts formed from electrically insulative material, including a left housing half and a right housing half that, when positioned in side-by-side assembly cooperate such that 1) the left side wall of the housing is defined by the left housing half, 2) the right side wall of the housing is defined by the right housing half, 3) the opposed end walls of the housing are cooperatively defined by opposed end wall portions of each of the left and right housing halves, and, 4) the front and rear walls of the housing are cooperatively defined by front and rear wall portions of each of the left and right housing halves;

c) an elongate metal mounting bracket having an elongate central portion configured to extend along selected portions of the rear wall of the housing, having connecting portions located near opposite ends of the elongate central portion with each of the connecting portions being configured to extend near a separate one of the end walls of the housing, and having end regions that are configured to project in opposite directions away from the end walls of the housing for connection to a conventional electrical connection box for supporting the receptacle within the electrical connection box;

d) connection means for connecting the left and right housing halves to the metal mounting bracket and for retaining the left and right housing halves in side-by-side assembly including receiving formations defined by the connecting portions of the mounting bracket, and projecting means defined by opposed end wall portions of each of the left and right housing halves and configured for being gripped by the receiving formations when the left and right housing halves are in side-by-side assembly;

e) circuit board means for being housed within the hollow interior of the housing near the rear wall for defining a first set of three electrically conductive surfaces located at the rear of the first passage, and a second set of three electrically conductive surfaces located at the rear of the second passage;

f) left circuit connection means carried by the left housing half for being electrically connected to a selected one of the three electrically conductive surfaces of each of the first and second sets, right circuit connection means carried by the right housing half for being electrically connected to another of the three electrically conductive surfaces of each of the first and second sets, and ground connection means for electrically connecting the metal mounting bracket with remaining ones of the three electrically conductive surfaces of each of the first and second sets;

g) first rotor means and second rotor means for extending into the first and second passages of the housing and for being journaled for rotation therein between off and on orientations, including first and second substantially identical, generally cylindrical rotors formed from electrically insulative material defining first and second front faces near where the first and second passages open through the front wall of the housing, and defining first and second sets of contact-receiving passages that open through the first and second front faces, respectively; and, h) first contact means and second contact means for being carried within the first and second sets of contact-receiving passages, for defining first and second sets of electrical contacts for establishing electrical connection with prongs of electrical plugs inserted into the first and second sets of contact-receiving passages, and for defining first and second sets of resilient contact end regions that extend rearwardly in the first and second passages for engaging the first and second sets of electrically conductive surfaces to supply electrical energy to a plug that has prongs inserted into the contact-receiving passages of any of the rotors in the on orientation, and for supplying no electrical energy to contacts carried within contact-receiving passages of any of the rotors in the off orientation.

40. The electrical receptacle of claim 39 wherein the projecting means defined by opposed end wall portions of the left and right housing halves include left end projections formed on the left housing half which are engageable, when the left and right housing halves are positioned side-by-side in assembly, with right end projections formed on the right housing half to define sets of engaged end projections located at opposite ends of the housing, and wherein the receiving formations defined by connecting portions of the mounting bracket include slot means for receiving and gripping the sets of engaged end projections.

41. The electrical receptacle of claim 39 wherein the slot means includes a plurality of slots, with each of the slots being configured to receive and grip a separate one of the sets of the left and right end projections.

42. The electrical receptacle of claim 39 wherein the ground connection means includes metal centerpost means for being positioned within the hollow interior of the housing for defining a rearwardly facing surface that is engageable with a forwardly facing surface of the circuit board means to establish electrical connection between the centerpost means and said remaining ones of the three electrically conductive surfaces, and clamping means for clamping the rearwardly facing surface and the forwardly facing surface together to maintain electrical connection therebetween.

43. The electrical receptacle of claim 42 wherein the clamping means includes a ground wire connection screw that extends through aligned holes formed in the mounting bracket, the rear wall of the housing, and the circuit board means, and threads into a threaded rear end region of the centerpost means.

44. The electrical receptacle of claim 42 wherein the clamping means includes a portion of the centerpost means that extends through aligned holes formed in the mounting bracket, the rear wall of the housing, and the circuit board means, and is rigidly connected to the mounting bracket.

45. The electrical receptacle of claim 39 wherein the mounting bracket includes tab means for being configured to extend through openings defined by the left and right housing halves and for being crimped near said openings to aid in establishing rigid connections between the left and right housing halves and the mounting bracket.

46. The electrical receptacle of claim 39 wherein:

a) the circuit board means defines a first forwardly facing recess of generally cylindrical configuration which is located at the rear of the first passages and a second forwardly facing recess of generally cylindrical configuration which is located at the rear of the second passage;

b) a chosen first one of the three electrically conductive surfaces of the first set of three electrically conductive surfaces includes a first annular conductive portion that extends in an uninterrupted ring about the circumference of the first recess, and a chosen first one of the three electrically conductive surfaces of the second set of three electrically conductive surfaces includes a second annular conductive portion that extends in an uninterrupted ring about the circumference of the second recess;

c) a chosen second one of the three electrically conductive surfaces of the first set of three electrically conductive surfaces includes a first round conductive portion that is located substantially centrally within the first recess, and a chosen second one of the three electrically conductive surfaces of the second set of three electrically conductive surfaces includes a second round conductive portion that is located substantially centrally within the second recess; and, d) a chosen third one of the three electrically conductive surfaces of the first set of three electrically conductive surfaces includes a first C-shaped portion that is provided within the first recess and wraps about the first round conductive portion at a distance spaced therefrom, and a chosen third one of the three electrically conductive surfaces of the second set of three electrically conductive surfaces includes a second C-shaped portion that is provided within the second recess and wraps about the second round conductive portion at a distance spaced therefrom.

47. The electrical receptacle of claim 46 wherein the first and second annular conductive portions, the first and second round conductive portions, and the first and second C-shaped portions all extend within substantially parallel planes.

48. The electrical receptacle of claim 47 wherein a majority of the rear wall of the housing is substantially flat and extends substantially parallel to said substantially parallel planes.

49. The electrical receptacle of claim 47 wherein the first and second annular conductive portions extend in a first common plane defined by portions of the circuit board means that surround the first and second recesses, and the first round conductive portion, the second round conductive portion, the first C-shaped portion and the second C-shaped portion extend in a second common plane defined by portions of the circuit board means located within the first and second recesses.

50. The electrical receptacle of claim 39 additionally including biasing means carried by the housing for releasably engaging detent formation means defined by the first rotor means and by the second rotor means for releasably retaining the first rotor means in at least a selected one of the off and on orientations of the first rotor means, and for releasably retaining the second rotor means in at least a selected one of the off and on orientations of the second rotor means.

51. The electrical receptacle of claim 50 wherein the biasing means includes an elongate leaf spring having rounded formations located near opposite ends thereof, wherein at least a selected one of the right and left housing halves defines a chamber that opens into the first and second passages wherein the leaf spring is supported such that each of the rounded formations thereof is biased toward a separate one of the first and second passages, and wherein the detent formation means includes exterior surface formations provided on the first and second rotor means for being engaged by the rounded formations when the first and second rotor means are in the selected orientations.

52. The electrical receptacle of claim 51 wherein the first and second rotor means define radially projecting flange portions that extend into said chamber, and the flange portions define the exterior surface formations that are engaged by the rounded formations when the first and second rotor means are in the selected orientations.

53. The electrical receptacle of claim 39 wherein:

a) the first rotor includes a first main rotor member having a first front wall portion of the first main rotor member that cooperates with a first tubular body portion of the first main rotor member which extends rearwardly from the first front wall portion to define a first hollow interior, and first insert means for extending into the first hollow interior and for cooperating with the first main rotor member to define the first set of three contact-receiving passages;

b) the first insert means includes a first insert member having a generally cylindrical outer surface with first groove means opening therethrough for cooperating with interior formations of the first main rotor member to connect the first set of three rotor contacts to the first rotor means for rotation therewith relative to the housing;

c) the second rotor includes a second main rotor member having a second front wall portion of the second main rotor member that cooperates with a second tubular body portion of the second main rotor member which extends rearwardly from the second front wall portion to define a second hollow interior, and second insert means for extending into the second hollow interior and for cooperating with the second main rotor member to define the second set of three contact-receiving passages; and, d) the second insert means includes a second insert member having a generally cylindrical outer surface with second groove means opening therethrough for cooperating with interior formations of the second main rotor member to connect the second set of three rotor contacts to the second rotor means for rotation therewith relative to the housing.

54. The electrical receptacle of claim 39 wherein the front face of the first rotor means and the front face of the second rotor means are of circular shape, and wherein the housing defines forwardly projecting lip formations for cooperating with the circular front faces of the first and second rotor means to extend into and to substantially fill first and second non-circular openings that are defined by a commercially available receptacle cover plate when the cover plate is installed on the receptacle.

* * * * *